US006721020B1

(12) United States Patent
Delametter et al.

(10) Patent No.: US 6,721,020 B1
(45) Date of Patent: Apr. 13, 2004

(54) THERMAL ACTUATOR WITH SPATIAL THERMAL PATTERN

(75) Inventors: Christopher N. Delametter, Rochester, NY (US); David P. Trauernicht, Rochester, NY (US); Edward P. Furlani, Lancaster, NY (US); John A. Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/293,653

(22) Filed: Nov. 13, 2002

(51) Int. Cl.[7] ..... B41J 2/04
(52) U.S. Cl. ..... 349/54
(58) Field of Search ..... 347/54, 55, 151, 347/120, 154, 141, 103, 123, 111, 159, 127, 128, 131, 125, 158, 68, 70–72, 50, 40, 20, 44, 47, 27, 63; 399/271, 290, 293, 294, 295

(56) References Cited

U.S. PATENT DOCUMENTS

| | | | |
|---|---|---|---|
| 3,747,120 | A | 7/1973 | Stemme |
| 3,946,398 | A | 3/1976 | Kyser et al. |
| 4,296,421 | A | 10/1981 | Hara et al. |

(List continued on next page.)

FOREIGN PATENT DOCUMENTS

| | | |
|---|---|---|
| JP | 20330543 | 1/1990 |

*Primary Examiner*—Raquel Yvette Gordon
(74) *Attorney, Agent, or Firm*—William R. Zimmerli

(57) ABSTRACT

An apparatus for and method of operating a thermal actuator for a micromechanical device, especially a liquid drop emitter such as an ink jet printhead, is disclosed. The disclosed thermal actuator comprises a base element and a cantilevered element including a thermo-mechanical bender portion extending from the base element to a free end tip. The thermo-mechanical bender portion includes a barrier layer constructed of a dielectric material having low thermal conductivity, a first deflector layer constructed of a first electrically resistive material having a large coefficient of thermal expansion, and a second deflector layer constructed of a second electrically resistive material having a large coefficient of thermal expansion wherein the barrier layer is bonded between the first and second deflector layers. The thermo-mechanical bender portion further has a base end adjacent the base element and a free end adjacent the free end tip. A first heater resistor is formed in the first deflector layer and adapted to apply heat energy having a first spatial thermal pattern which results in a first deflector layer base end temperature increase, $\Delta T_{1b}$, that is greater than a first deflector layer free end temperature increase, $\Delta T_{1f}$. A second heater resistor is formed in the second deflector layer and adapted to apply heat energy having a second spatial thermal pattern which results in a second deflector layer base end temperature increase, $\Delta T_{2b}$ that is greater than a second deflector layer free end temperature increase, $\Delta T_{2f}$. Application of an electrical pulse to either the first or second heater resistors causes deflection of the cantilevered element, followed by restoration of the cantilevered element to an initial position as heat diffuses through the barrier layer and the cantilevered element reaches a uniform temperature. For liquid drop emitter embodiments, the thermal actuator resides in a liquid-filled chamber that includes a nozzle for ejecting liquid. Application of electrical pulses to the heater resistors is used to adjust the characteristics of liquid drop emission. The barrier layer exhibits a heat transfer time constant $\tau_B$. The thermal actuator is activated by a heat pulses of duration $\tau_p$ wherein $\tau_p < \frac{1}{2}\tau_B$.

91 Claims, 22 Drawing Sheets

U.S. PATENT DOCUMENTS

| | | | |
|---|---|---|---|
| 5,599,695 | A | 2/1997 | Pease et al. |
| 5,771,882 | A | 6/1998 | Psaros et al. |
| 5,902,648 | A | 5/1999 | Naka et al. |
| 6,067,797 | A | 5/2000 | Silverbrook |
| 6,087,638 | A | 7/2000 | Silverbrook |
| 6,180,427 | B1 | 1/2001 | Silverbrook |
| 6,209,989 | B1 | 4/2001 | Silverbrook |
| 6,234,609 | B1 | 5/2001 | Silverbrook |
| 6,239,821 | B1 | 5/2001 | Silverbrook |
| 6,243,113 | B1 | 6/2001 | Silverbrook |
| 6,247,791 | B1 | 6/2001 | Silverbrook |
| 6,254,793 | B1 | 7/2001 | Silverbrook |
| 6,258,284 | B1 | 7/2001 | Silverbrook |
| 6,274,056 | B1 | 8/2001 | Silverbrook |
| 6,364,453 | B1 | 4/2002 | Silverbrook |

THERMAL ACTUATOR WITH SPATIAL THERMAL PATTERN

CROSS REFERENCE TO RELATED APPLICATION

Reference is made to commonly-assigned co-pending U.S. patent applications: U.S. Ser. No. 10/154,634, entitled "Multi-layer Thermal Actuator with Optimized Heater Length and Method of Operating Same," of Cabal, et al.; U.S. Ser. No. 10/071,120, entitled "Tri-Layer Thermal Actuator and Method of Operating," of Furlani, et al.; U.S. Ser. No. 10/050,993 entitled "Thermal Actuator with Optimized Heater Length" of Cabal et al.; and U.S. Pat. No. 6,464,341 entitled "Dual Actuation Thermal Actuator and Method of Operating Thereof" of Furlani, et al.

FIELD OF THE INVENTION

The present invention relates generally to micro-electromechanical devices and, more particularly, to micro-electromechanical thermal actuators such as the type used in ink jet devices and other liquid drop emitters.

BACKGROUND OF THE INVENTION

Micro-electro mechanical systems (MEMS) are a relatively recent development. Such MEMS are being used as alternatives to conventional electromechanical devices as actuators, valves, and positioners. Micro-electromechanical devices are potentially low cost, due to use of microelectronic fabrication techniques. Novel applications are also being discovered due to the small size scale of MEMS devices.

Many potential applications of MEMS technology utilize thermal actuation to provide the motion needed in such devices. For example, many actuators, valves and positioners use thermal actuators for movement. In some applications the movement required is pulsed. For example, rapid displacement from a first position to a second, followed by restoration of the actuator to the first position, might be used to generate pressure pulses in a fluid or to advance a mechanism one unit of distance or rotation per actuation pulse. Drop-on-demand liquid drop emitters use discrete pressure pulses to eject discrete amounts of liquid from a nozzle.

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electrically resistive heaters to generate vapor bubbles which cause drop emission, as is discussed by Hara et al., in U.S. Pat. No. 4,296,421.

Electrically resistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezo-electrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro-analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission is needed which can be used with a broad range of liquid formulations. Apparatus and methods are needed which combine the advantages of microelectronic fabrication used for thermal ink jet with the liquid composition latitude available to piezo-electromechanical devices.

A DOD ink jet device which uses a thermo-mechanical actuator was disclosed by T. Kitahara in JP 2,030,543, filed Jul. 21, 1988. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission. Recently, disclosures of a similar thermo-mechanical DOD ink jet configuration have been made by K. Silverbrook in U.S. Pat. Nos. 6,067,797; 6,087,638; 6,209,989; 6,234,609; 6,239,821; and 6,247,791. Methods of manufacturing thermo-mechanical ink jet devices using microelectronic processes have been disclosed by K. Silverbrook in U.S. Pat. Nos. 6,180,427; 6,254,793; 6,258,284 and 6,274,056. The term "thermal actuator" and thermno-mechanical actuator will be used interchangeably herein.

A useful design for thermo-mechanical actuators is a layered, or laminated, cantilevered beam anchored at one end to the device structure with a free end that deflects perpendicular to the beam. The deflection is caused by setting up thermal expansion gradients in the layered beam, perpendicular to the laminations. Such expansion gradients may be caused by temperature gradients among layers. It is advantageous for pulsed thermal actuators to be able to establish such temperature gradients quickly, and to dissipate them quickly as well, so that the actuator will rapidly restore to an initial position. An optimized cantilevered element may be constructed by using electroresistive materials which are partially patterned into heating resisters for some layers.

A dual actuation thermal actuator configured to generate opposing thermal expansion gradients, hence opposing beam deflections, is useful in a liquid drop emitter to generate pressure impulses at the nozzle which are both positive and negative. Control over the generation and timing of both positive and negative pressure impulses allows fluid and nozzle meniscus effects to be used to favorably alter drop emission characteristics.

The spatial pattern of thermal heating may be altered to result in more deflection for less input of electrical energy. K. Silverbrook has disclosed thermal actuators which have spatially non-uniform thermal patterns in U. S. Pat. Nos. 6,243,113 and 6,364,453. However, the thermo-mechanical bending portions of the disclosed thermal actuators are not configured to be operated in contact with a liquid, rendering them unreliable for use in such devices as liquid drop emitters and microvalves. The disclosed designs are based on coupled arm structures which are inherently difficult to fabricate, may develop post-fabrication twisted shapes, and are subject to easy mechanical damage. The thermal actuator designs disclosed in Silverbrook '113 have structurally weak base ends which are subjected to peak temperatures, possibly causing early failure.

Further, the thermal actuator designs disclosed in Silverbrook '453 are directed at solving an anticipated problem of an excessive temperature increase in the center of the thermal actuator, and do not offer increased energy efficiency during actuation. The disclosed actuator designs have heat sink components which increase undesirable liquid backpressure effects when used immersed in a liquid, and, further, add isolated mass which may slow actuator cool down, limiting maximum reliable operating frequencies.

Cantilevered element thermal actuators, which can be operated with reduced energy and at acceptable peak temperatures, and which can be deflected in controlled displacement versus time profiles, are needed in order to build systems that can be fabricated using MEMS fabrication methods and also enable liquid drop emission at high repetition frequency with excellent drop formation characteristics.

SUMMARY OF THE INVENTION

It is therefore an object of the present invention to provide a thermo-mechanical actuator which uses reduced input energy and which does not require excessive peak temperatures.

It is also an object of the present invention to provide an energy efficient thermal actuator which comprises dual actuation means that move the thermal actuator in substantially opposite directions allowing rapid restoration of the actuator to a nominal position and more rapid repetitions.

It is further an object of the present invention to provide an energy efficient cantilevered thermal actuator which is actuated by heat pulses having a spatial thermal pattern wherein the base end increases to a higher temperature than the free end of a thermo-mechanical bender portion.

The foregoing and numerous other features, objects and advantages of the present invention will become readily apparent upon a review of the detailed description, claims and drawings set forth herein. These features, objects and advantages are accomplished by constructing a thermal actuator for a micro-electromechanical device comprising a base element and a cantilevered element including a thermo-mechanical bender portion extending from the base element and a free end tip which resides in a first position. The thermo-mechanical bender portion has a base end adjacent the base element and a free end adjacent the free end tip. Apparatus adapted to apply a heat pulse directly to the thermo-mechanical bender portion is provided. The heat pulses have a spatial thermal pattern which results in a greater temperature increase of the base end than the free end of the thermo-mechanical bender portion. The rapid heating of the thermo-mechanical bender portion causes the deflection of the free end tip of the cantilevered element to a second position.

The features, objects and advantages are also accomplished by constructing a thermo-mechanical bender portion which includes a barrier layer constructed of a dielectric material having low thermal conductivity, a first deflector layer constructed of a first electrically resistive material having a large coefficient of thermal expansion, and a second deflector layer constructed of a second electrically resistive material having a large coefficient of thermal expansion wherein the barrier layer is bonded between the first and second deflector layers. A first heater resistor is formed in the first deflector layer and adapted to apply heat energy having a first spatial thermal pattern which results in a first deflector layer base end temperature increase, $\Delta T_{1b}$, in the first deflector layer at the base end that is greater than a first deflector layer free end temperature increase, $\Delta T_{1f}$, in the first deflector layer at the free end. A second heater resistor is formed in the second deflector layer and adapted to apply heat energy having a second spatial thermal pattern which results in a second deflector layer base end temperature increase, $\Delta T_{2b}$, in the second deflector layer at the base end that is greater than a second deflector layer free end temperature increase, $\Delta T_{2f}$, in the second deflector layer at the free end. A first pair of electrodes is connected to the first heater resistor to apply an electrical pulse to cause resistive heating of the first deflector layer, resulting in a thermal expansion of the first deflector layer relative to the second deflector layer. A second pair of electrodes is connected to the second heater resistor portion to apply an electrical pulse to cause resistive heating of the second deflector layer, resulting in a thermal expansion of the second deflector layer relative to the first deflector layer. Application of an electrical pulse to either the first pair or the second pair of electrodes causes deflection of the cantilevered element away from the first position to a second position, followed by restoration of the cantilevered element to the first position as heat diffuses through the barrier layer and the cantilevered element reaches a uniform temperature.

The present inventions are particularly useful as thermal actuators for liquid drop emitters used as printheads for DOD ink jet printing. In these preferred embodiments the thermal actuator resides in a liquid-filled chamber that includes a nozzle for ejecting liquid. The thermal actuator includes a cantilevered element extending from a wall of the chamber and a free end residing in a first position proximate to the nozzle. Application of an electrical pulse to either the first pair or the second pair of electrodes causes deflection of the cantilevered element away from its first position and, alternately, causes a positive or negative pressure in the liquid at the nozzle. Application of electrical pulses to the first and second pairs of electrodes, and the timing thereof, are used to adjust the characteristics of liquid drop emission.

DETAILED DESCRIPTION OF THE INVENTION

The invention has been described in detail with particular reference to certain preferred embodiments thereof, but it will be understood that variations and modifications can be effected within the spirit and scope of the invention.

As described in detail hereinbelow, the present invention provides apparatus for a thermo-mechanical actuator and a drop-on-demand liquid emission device and methods of operating same. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide apparatus and methods for operating drop emitters based on thermal actuators so as to improve overall drop emission productivity.

Figure 1:
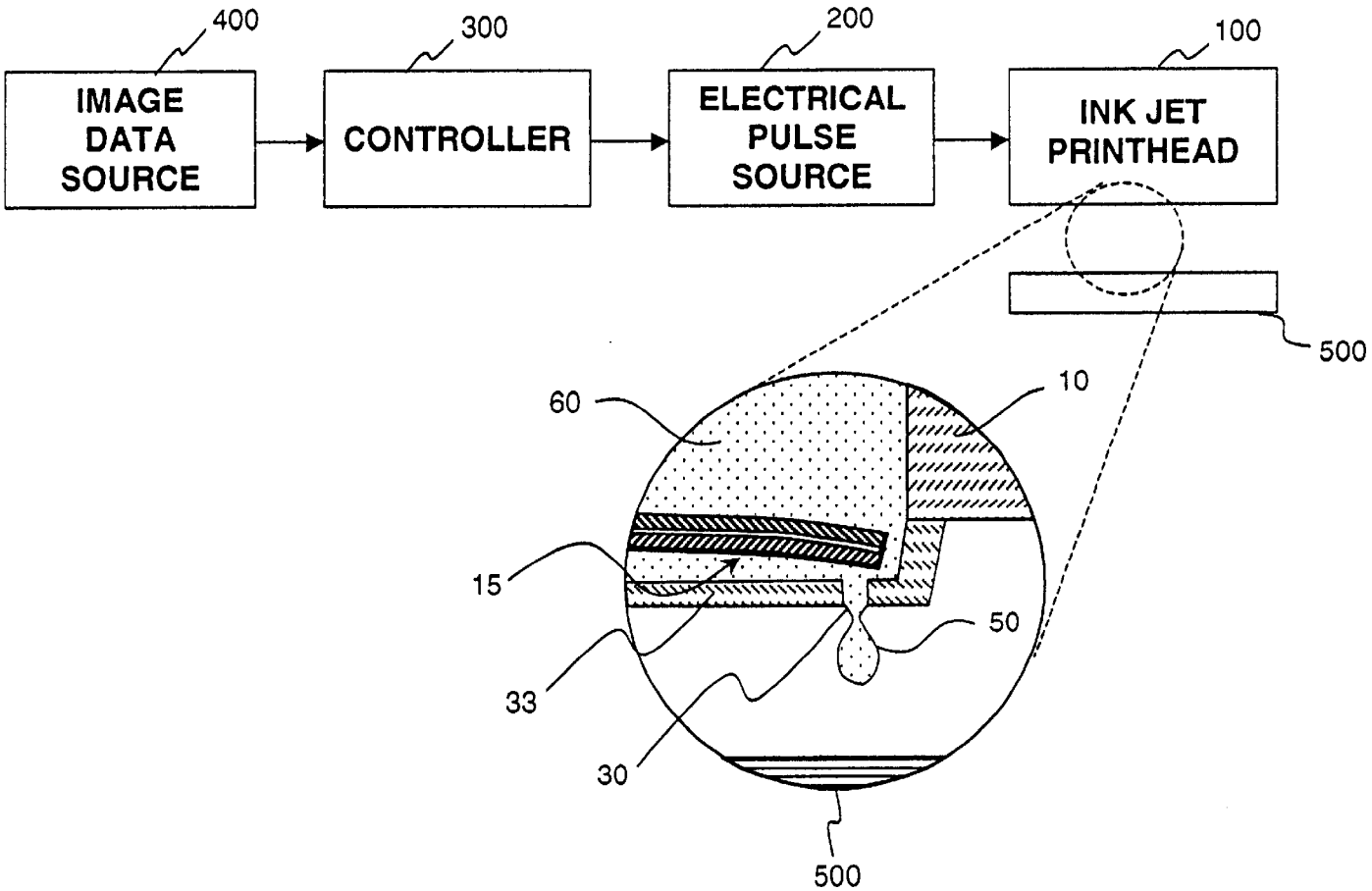
FIG. 1 is a schematic illustration of an ink jet system according to the present invention.

Turning first to FIG. 1, there is shown a schematic representation of an ink jet printing system which may use an apparatus and be operated according to the present invention. The system includes an image data source 400 which provides signals that are received by controller 300 as commands to print drops. Controller 300 outputs signals to a source of electrical pulses 200. Pulse source 200, in turn, generates an electrical voltage signal composed of electrical energy pulses which are applied to electrically resistive means associated with each thermal actuator 15 within ink jet printhead 100. The electrical energy pulses cause a thermal actuator 15 to rapidly bend, pressurizing ink 60 located at nozzle 30, and emitting an ink drop 50 which lands on receiver 500. Some drop emitters may emit a main drop and very small trailing drops, termed satellite drops. The present invention assumes that such satellite drops are considered part of the main drop emitted in serving the overall application purpose, e.g., for printing an image pixel or for micro dispensing an increment of fluid.

Figure 2:
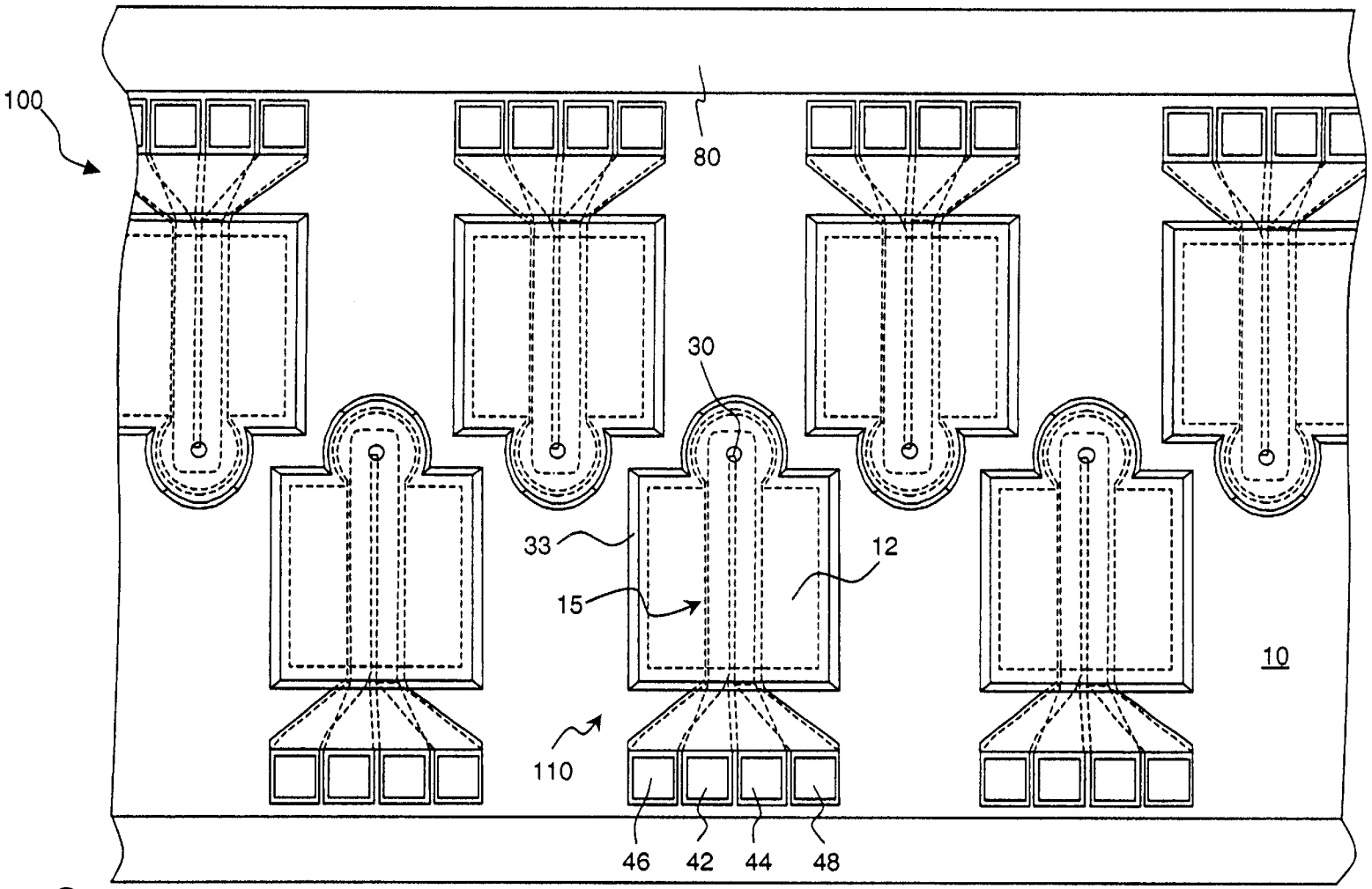
FIG. 2 is a plan view of an array of ink jet units or liquid drop emitter units according to the present invention.

FIG. 2 shows a plan view of a portion of ink jet printhead 100. An array of thermally actuated ink jet units 110 is shown having nozzles 30 centrally aligned, and ink chambers 12, interdigitated in two rows. The ink jet units 110 are formed on and in a substrate 10 using microelectronic fabrication methods. An example fabrication sequence which may be used to form drop emitters 110 is described in co-pending application Ser. No. 09/726,945 filed Nov. 30, 2000, for "Thermal Actuator", assigned to the assignee of the present invention.

Each drop emitter unit 110 has an associated first pair of electrodes 42, 44 which are formed with, or are electrically connected to, an electrically resistive heater portion in a first deflector layer of a thermo-mechanical bender portion of the thermal actuator and which participates in the thermo-mechanical effects as will be described hereinbelow. Each drop emitter unit 110 also has an associated second pair of electrodes 46, 48 which are formed with, or are electrically connected to, an electrically resistive heater portion in a second deflector layer of the thermo-mechanical bender portion and which also participates in the thermo-mechanical effects as will be described hereinbelow. The heater resistor portions formed in the first and second deflector layers are above one another and are indicated by phantom lines in FIG. 2. Element 80 of the printhead 100 is a mounting structure which provides a mounting surface for microelectronic substrate 10 and other means for interconnecting the liquid supply, electrical signals, and mechanical interface features.

Figure 3A:
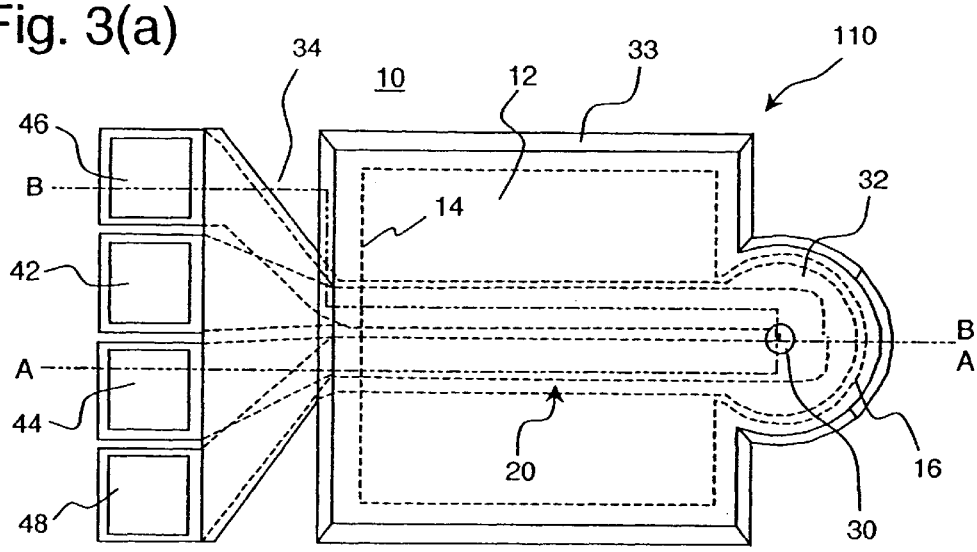
FIGS. 3(*a*)–3(*b*) are enlarged plan views of an individual ink jet unit shown in FIG. 2.
Figure 3B:
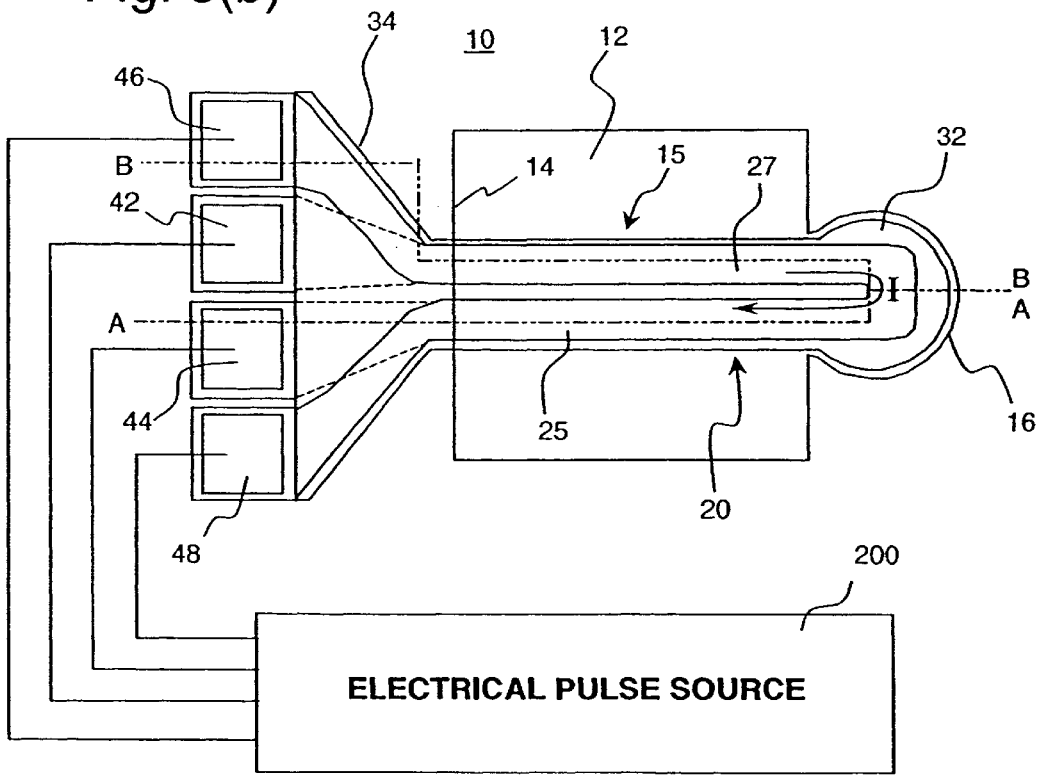

FIG. 3*a* illustrates a plan view of a single drop emitter unit 110 and, a second plan view, FIG. 3*b*, with the liquid chamber cover 33, including nozzle 30, removed. The thermal actuator 15, shown in phantom in FIG. 3*a* can be seen with solid lines in FIG. 3*b*. The cantilevered element 20 of thermal actuator 15 extends from edge 14 of liquid chamber 12 which is formed in substrate 10. Cantilevered element portion 34 is bonded to substrate 10 which serves as a base element anchoring the cantilever.

The cantilevered element 20 of the actuator has the shape of a paddle, an extended, flat shaft ending with a disc of larger diameter than the final shaft width. This shape is merely illustrative of cantilever actuators which can be used, many other shapes are applicable as will be described hereinbelow. The disc-shape aligns the nozzle 30 with the center of the cantilevered element free end tip 32. The fluid chamber 12 has a curved wall portion at 16 which conforms to the curvature of the free end tip 32, spaced away to provide clearance for the actuator movement.

FIG. 3*b* illustrates schematically the attachment of electrical pulse source 200 to a second heater resistor 27 (shown in phantom) formed in the second deflector layer of the thermo-mechanical bender portion 25 at a second pair of electrodes 46 and 48. Voltage differences are applied to electrodes 46 and 48 to cause resistance heating of the second deflector layer. A first heater resistor 26 formed in the first deflector layer is hidden below second heater resistor 27 (and a barrier layer) but may be seen indicated by phantom lines emerging to make contact to a first pair of electrodes 42 and 44. Voltage differences are applied to electrodes 42 and 44 to cause resistance heating of the first deflector layer. Heater resistors 26 and 27 are designed to provide a spatial thermal pattern to the layer in which they are patterned. While illustrated as four separate electrodes 42, 44, 46, and 48, having connections to electrical pulse source 200, one member of each pair of electrodes could be brought into electrical contact at a common point so that heater resistors 26 and 27 could be addressed using three inputs from electrical pulse source 200.

In the plan views of FIGS. 3*a* and 3*b*, the actuator free end 32 moves toward the viewer when the first deflector layer is heated appropriately by first heater resistor 26 and drops are emitted toward the viewer from the nozzle 30 in liquid chamber cover 33. This geometry of actuation and drop emission is called a "roof shooter" in many ink jet disclosures. The actuator free end 32 moves away from the viewer of FIGS. 3*a* and 3*b*, and nozzle 30, when the second deflector layer is heated by second heater resistor 27. This actuation of free end 32 away from nozzle 30 may be used to restore the cantilevered element 20 to a nominal position, to alter the state of the liquid meniscus at nozzle 30, to change the liquid pressure in the fluid chamber 12 or some combination of these and other effects.

Figure 4A:
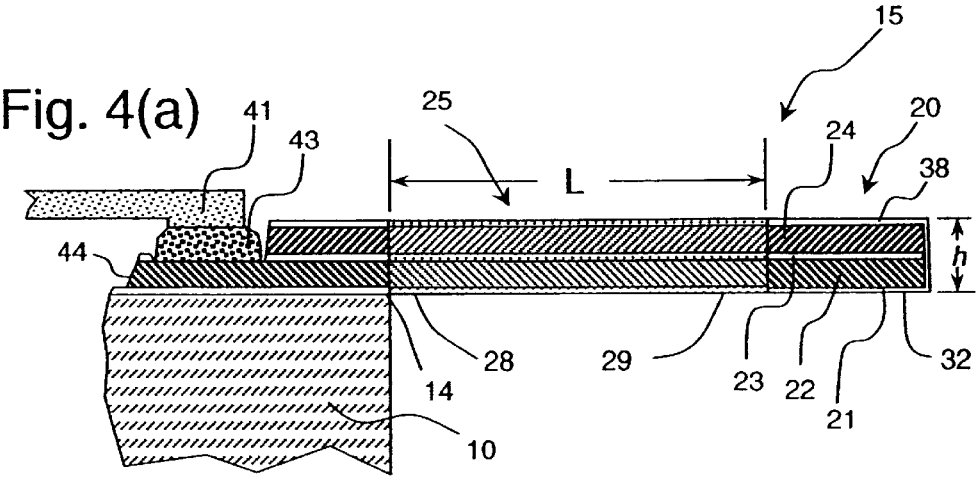
FIGS. 4(*a*)–4(*c*) are side views illustrating the movement of a thermal actuator according to the present invention.
Figure 4B:
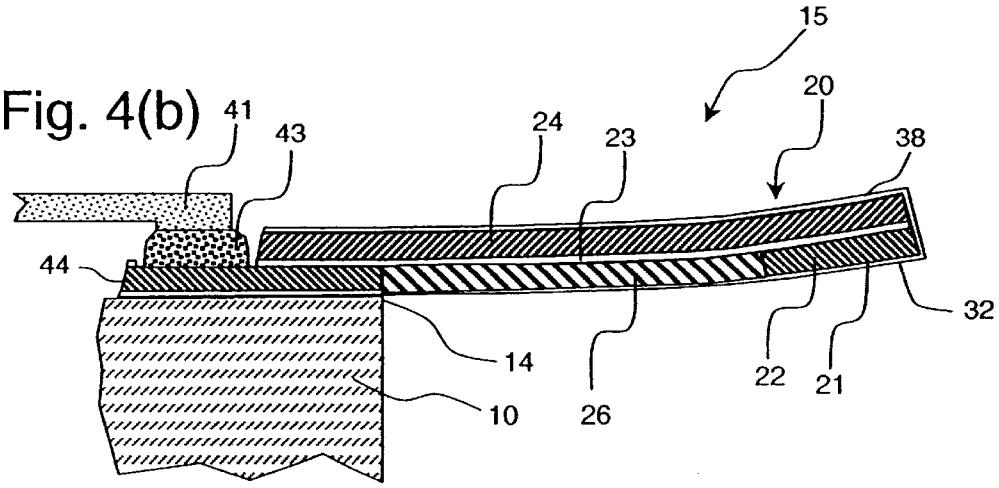
Figure 4C:
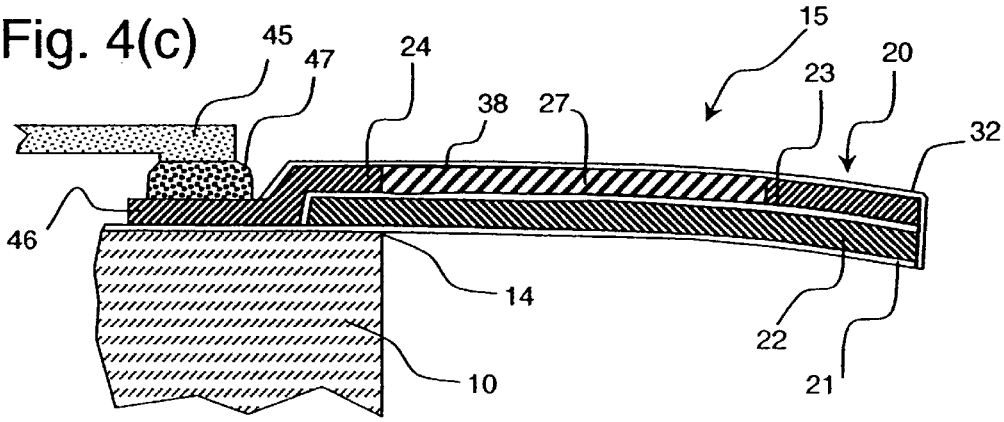

FIGS. 4*a*–4*c* illustrate in side view cantilevered thermal actuators according to a preferred embodiment of the present invention. In FIG. 4*a* thermal actuator 15 is in a first position and in FIG. 4*b* it is shown deflected upward to a second position. The side views of FIGS. 4*a* and 4*b* are formed along line A—A in plan view FIG. 3*b*. In side view FIG. 4*c*, formed along line B—B of plan view FIG. 3*b*, thermal actuator 15 is illustrated as deflected downward to a third position. Cantilevered element 20 is anchored to substrate 10 which serves as a base element for the thermal actuator. Cantilevered element 20 includes a thermo-mechanical bender portion 25 extending a length L from wall edge 14 of substrate base element 10. Thermo-mechanical bender portion 25 has a base end 28 adjacent base element 10 and a free end 29 adjacent free end tip 32. The overall thickness, h, of cantilevered element 20 and thermo-mechanical bender portion 25 is indicated in FIG. 4.

Cantilevered element 20, including thermo-mechanical bender portion 25, is constructed of several layers or laminations. Layer 22 is the first deflector layer which causes the upward deflection when it is thermally elongated with respect to other layers in cantilevered element 20. Layer 24 is the second deflector layer which causes the downward deflection of thermal actuator 15 when it is thermally elongated with respect of the other layers in cantilevered element 20. First and second deflector layers are preferably constructed of materials that respond to temperature with substantially the same thermo-mechanical effects.

The second deflector layer mechanically balances the first deflector layer, and vice versa, when both are in thermal equilibrium. This balance many be readily achieved by using the same material for both the first deflector layer 22 and the second deflector layer 24. The balance may also be achieved by selecting materials having substantially equal coefficients of thermal expansion and other properties to be discussed hereinbelow.

For some of the embodiments of the present invention the second deflector layer 24 is not patterned with a second uniform resister portion 27. For these embodiments, second deflector layer 24 acts as a passive restorer layer which mechanically balances the first deflector layer when the cantilevered element 20 reaches a uniform internal temperature.

The cantilevered element 20 also includes a barrier layer 23, interposed between the first deflector layer 22 and second deflector layer 24. The barrier layer 23 is constructed of a material having a low thermal conductivity with respect to the thermal conductivity of the material used to construct the first deflector layer 22. The thickness and thermal conductivity of barrier layer 23 is chosen to provide a desired time constant $\tau_B$ for heat transfer from first deflector layer 22 to second deflector layer 24. Barrier layer 23 may also be a dielectric insulator to provide electrical insulation, and partial physical definition, for the electrically resistive heater portions of the first and second deflector layers.

Barrier layer 23 may be composed of sub-layers, laminations of more than one material, so as to allow optimization of functions of heat flow management, electrical isolation, and strong bonding of the layers of the cantilevered element 20. Multiple sub-layer construction of barrier layer 23 may also assist the discrimination of patterning fabrication processes utilized to form the heater resistors of the first and second deflector layers.

First and second deflector layers 22 and 24 likewise may be composed of sub-layers, laminations of more than one material, so as to allow optimization of functions of electrical parameters, thickness, balance of thermal expansion effects, electrical isolation, strong bonding of the layers of the cantilevered element 20, and the like. Multiple sub-layer construction of first and second deflector layers 22 and 24 may also assist the discrimination of patterning fabrication processes utilized to form the heater resistors of the first and second deflector layers.

In some alternate embodiments of the present inventions, the barrier layer 23 is provided as a thick layer constructed of a dielectric material having a low coefficient of thermal expansion and the second deflector layer 24 is deleted. For these embodiments the dielectric material barrier layer 23 performs the role of a second layer in a bi-layer thermo-mechanical bender. The first deflector layer 22, having a large coefficient of thermal expansion provides the deflection force by expanding relative to a second layer, in this case barrier layer 23.

Passivation layer 21 and overlayer 38 shown in FIGS. 4*a*–4*c* are provided to protect the cantilevered element 20 chemically and electrically. Such protective layers may not be needed for some applications of thermal actuators according to the present inventions, in which case they may be deleted. Liquid drop emitters utilizing thermal actuators which are touched on one or more surfaces by the working liquid may require passivation layer 21 and overlayer 38 which are made chemically and electrically inert to the working liquid.

In FIG. 4*b*, a heat pulse has been applied to first deflector layer 22, causing it to rise in temperature and elongate. Second deflector layer 24 does not elongate initially because barrier layer 23 prevents immediate heat transfer to it. The difference in temperature, hence, elongation, between first deflector layer 22 and the second deflector layer 24 causes the cantilevered element 20 to bend upward. When used as actuators in drop emitters the bending response of the cantilevered element 20 must be rapid enough to sufficiently pressurize the liquid at the nozzle. Typically, first heater resistor 26 of the first deflector layer is adapted to apply appropriate heat pulses when an electrical pulse duration of less than 10 μsecs., and, preferably, a duration less than 4 μsecs., is used.

In FIG. 4*c*, a heat pulse has been applied to second deflector layer 24, causing it to rise in temperature and elongate. First deflector layer 22 does not elongate initially because barrier layer 23 prevents immediate heat transfer to it. The difference in temperature, hence, elongation, between second deflector layer 24 and the first deflector layer 22 causes the cantilevered element 20 to bend downward. Typically, second heater resistor 27 of the second deflector layer is adapted to apply appropriate heat pulses when an electrical pulse duration of less than 10 μsecs., and, preferably, a duration less than 4 μsecs., is used.

Depending on the application of the thermal actuator, the energy of the electrical pulses, and the corresponding amount of cantilever bending that results, may be chosen to be greater for one direction of deflection relative to the other. In many applications, deflection in one direction will be the primary physical actuation event. Deflections in the opposite direction will then be used to make smaller adjustments to the cantilever displacement for pre-setting a condition or for restoring the cantilevered element to its quiescent first position.

FIGS. 5 through 14*c* illustrate fabrication processing steps for constructing a single liquid drop emitter according to some of the preferred embodiments of the present invention. For these embodiments the first deflector layer 22 is constructed using an electrically resistive material, such as titanium aluminide, and a portion is patterned into a resistor for carrying electrical current. A second deflector layer 24 is constructed also using an electrically resistive material, such as titanium aluminide, and a portion is patterned into a resistor for carrying electrical current. A dielectric barrier layer 23 is formed in between first and second deflector layers to control heat transfer timing between deflector layers.

For other embodiments of the present inventions, the second deflector layer 24 is omitted and a thick barrier layer 23 serves as a low thermal expansion second layer, together with high expansion first deflector layer 22, in forming a bi-layer thermo-mechanical bender portion of a cantilevered element thermal actuator.

The present inventions include the application of a heat pulse having a spatial thermal pattern when operating the thermal actuators. The spatial thermal pattern may be created by a number of design and fabrication approaches. For example, the resistivity of any electrically resistive material layers may be modified to render them more conductive in a desired spatial pattern. Alternatively, additional layers of conductive material or thin film resistor material may be added and patterned to apply heat pulses and to create a desired spatial thermal pattern.

Figure 5:
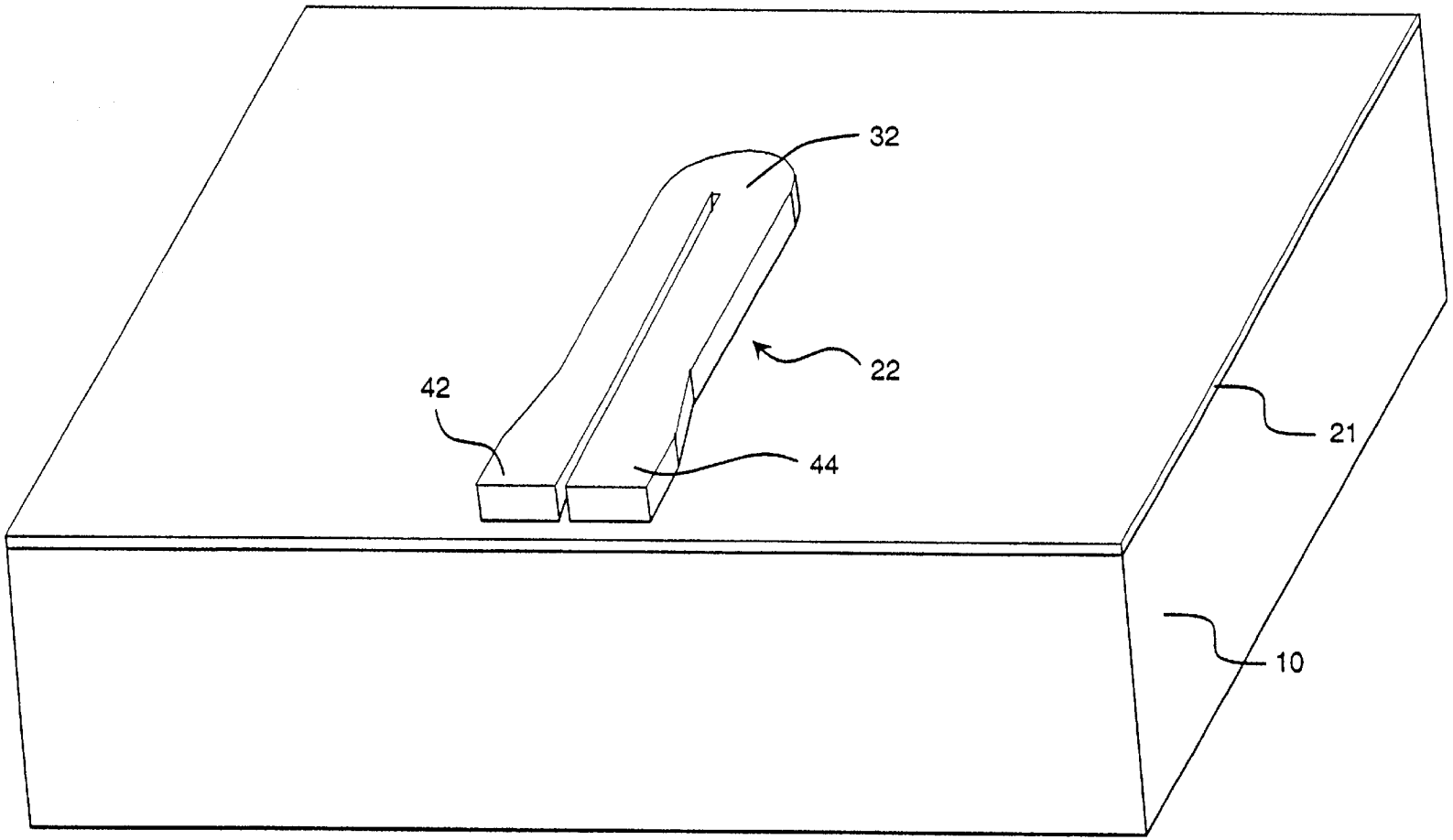
FIG. 5 is a perspective view of the early stages of a process suitable for constructing a thermal actuator according to the present invention wherein a first deflector layer of the cantilevered element is formed and patterned.

FIG. 5 illustrates in perspective view a first deflector layer 22 portion of a cantilever, as shown in FIG. 3*b*, in a first stage of fabrication. A first material having a high coefficient of thermal expansion, for example titanium aluminide, is deposited and patterned to form the first deflector layer structure. The illustrated structure is formed on a substrate 10, for example, single crystal silicon, by standard microelectronic deposition and patterning methods. Deposition of intermetallic titanium aluminide may be carried out, for example, by RF or pulsed DC magnetron sputtering. First deflector layer 22 is patterned to partially form a first heater resistor. The free end tip 32 portion of the first deflector layer is labeled for reference. First electrode pair 42 and 44 will eventually be attached to a source of electrical pulses 200.

Figure 6:
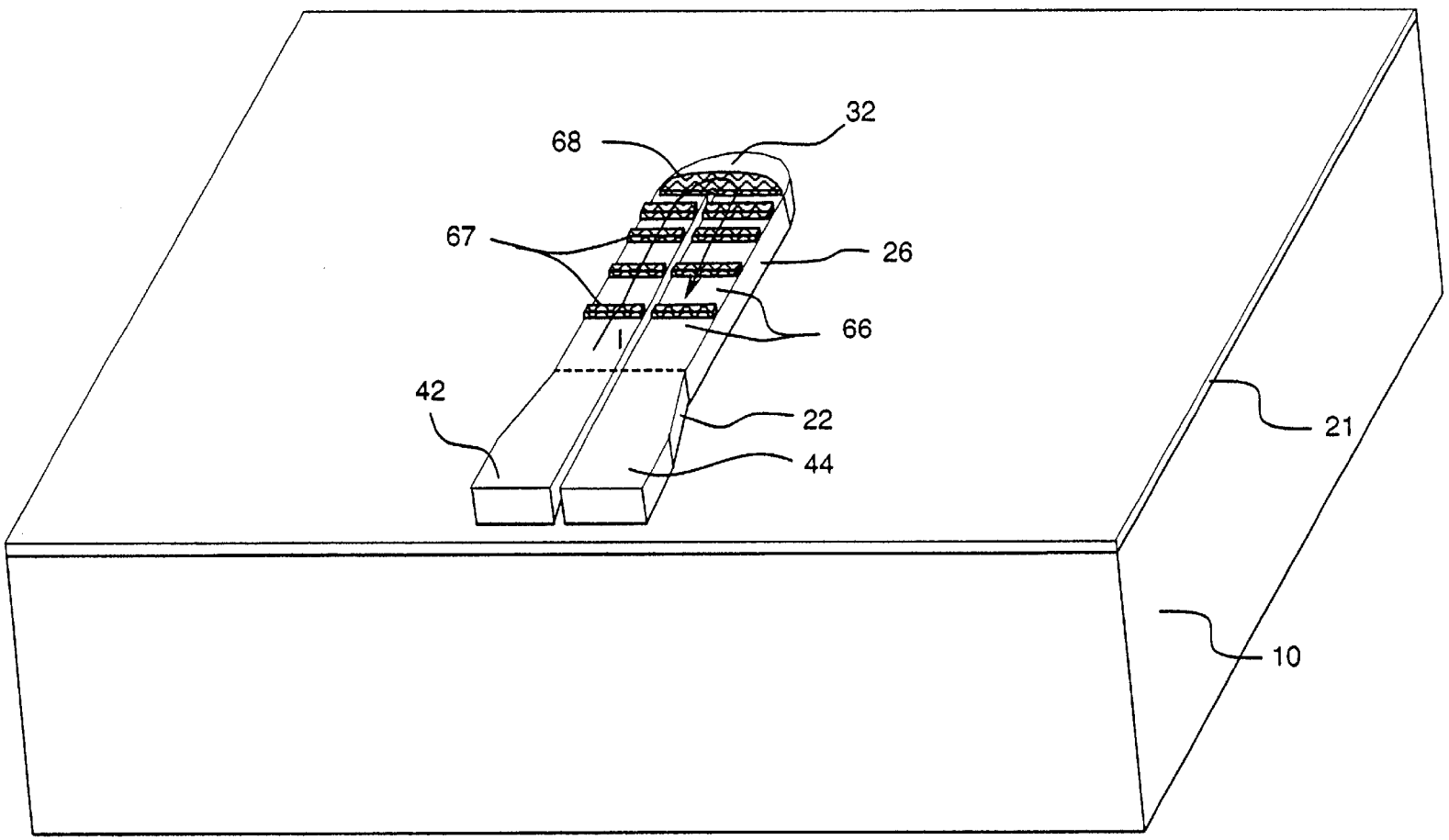
FIG. 6 is a perspective view of a next stage of a process suitable for construction a thermal actuator according to the present inventions wherein a first heater resistor is completed in the first deflector layer by addition of conductive material and patterning.

FIG. 6 illustrates in perspective view a next step in the fabrication wherein a conductive material is deposited and delineated in a current shunt pattern, completing the formation of first heater resistor 26 in first deflector layer 22. Typically the conductive layer will be formed of a metal conductor such as aluminum. However, overall fabrication process design considerations may be better served by other higher temperature materials, such as silicides, which have less conductivity than a metal but substantially higher conductivity than the conductivity of the electrically resistive material.

First heater resister 26 is comprised of heater resistor segments 66 formed in the first material of the first deflector layer 22, a current coupling shunt 68 which conducts current serially from input electrode 42 to input electrode 44, and current shunts 67 which modify the power density of electrical energy input to the first resistor. Heater resistor segments 66 and current shunts 67 are designed to establish a spatial thermal pattern in the first deflector layer. The current path is indicated by an arrow and letter "I".

Electrodes 42, 44 may make contact with circuitry previously formed in substrate 10 or may be contacted externally by other standard electrical interconnection methods, such as tape automated bonding (TAB) or wire bonding. A passivation layer 21 is formed on substrate 10 before the deposition and patterning of the first material. This passivation layer may be left under deflector layer 22 and other subsequent structures or patterned away in a subsequent patterning process.

An alternative approach to that illustrated in FIG. 6 would be to modify the resistivity of the first deflector layer material to make it significantly more conductive in a spatial pattern similar to the illustrated current shunt pattern. Increased conductivity may be achieved by in situ processing of the electrically resistive material forming first layer 22. Examples of in situ processing to increase conductivity include laser annealing, ion implantation through a mask, or thermal diffusion doping.

Figure 7:
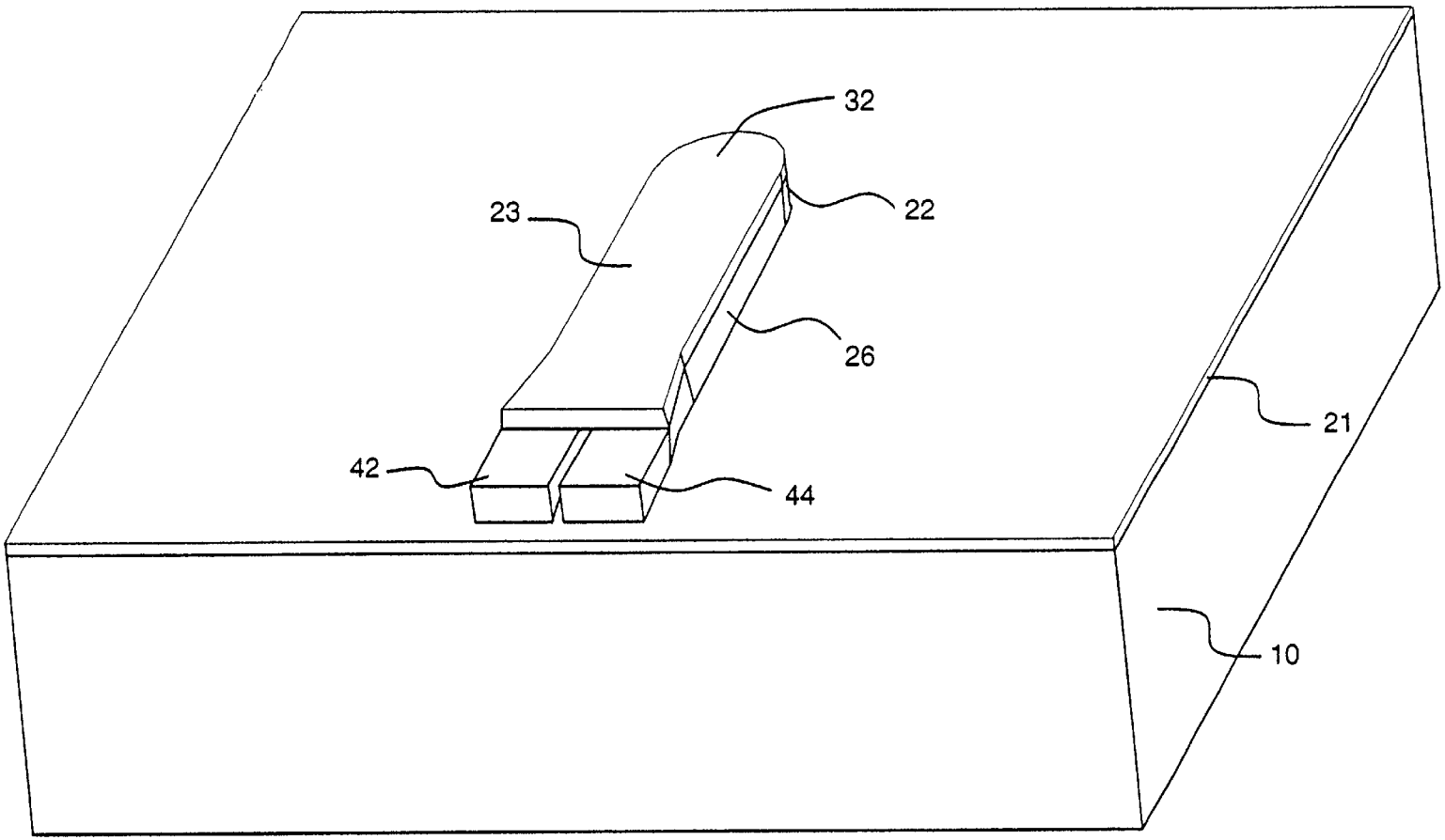
FIG. 7 is a perspective view of the next stages of the process illustrated in FIGS. 5–6 wherein a second layer or a barrier layer of the cantilevered element is formed.

FIG. 7 illustrates in perspective view a barrier layer 23 having been deposited and patterned over the previously formed first deflector layer 22 and the first heater resistor 26. The barrier layer 23 material has low thermal conductivity compared to the first deflector layer 22. For example, barrier layer 23 may be silicon dioxide, silicon nitride, aluminum oxide or some multi-layered lamination of these materials or the like. The barrier layer 23 material is also a good electrical insulator, a dielectric, providing electrical passivation for the first heater resistor components previously discussed.

Favorable efficiency of the thermal actuator is realized if the barrier layer 23 material has thermal conductivity substantially below that of both the first deflector layer 22 material and the second deflector layer 24 material. For example, dielectric oxides, such as silicon oxide, will have thermal conductivity several orders of magnitude smaller than intermetallic materials such as titanium aluminide. Low thermal conductivity allows the barrier layer 23 to be made thin relative to the first deflector layer 22 and second deflector layer 24. Heat stored by barrier layer 23 is not useful for the thermo-mechanical actuation process. Minimizing the volume of the barrier layer improves the energy efficiency of the thermal actuator and assists in achieving rapid restoration from a deflected position to a starting first position. The thermal conductivity of the barrier layer 23 material is preferably less than one-half the thermal conductivity of the first deflector layer or second deflector layer materials, and more preferably, less than one-tenth.

In some embodiments of the present invention, barrier layer 23 is formed as a thick layer having a thickness comparable to or greater than the thickness of the first deflector layer. In these embodiments barrier layer 23 serves as a low thermal expansion second layer, together with high expansion first deflection layer 22, in forming a bi-layer thermo-mechanical bender portion of a cantilevered element thermal actuator. For these embodiments the next three or four fabrication steps, illustrated in FIGS. 8–11, may be omitted.

Figure 8:
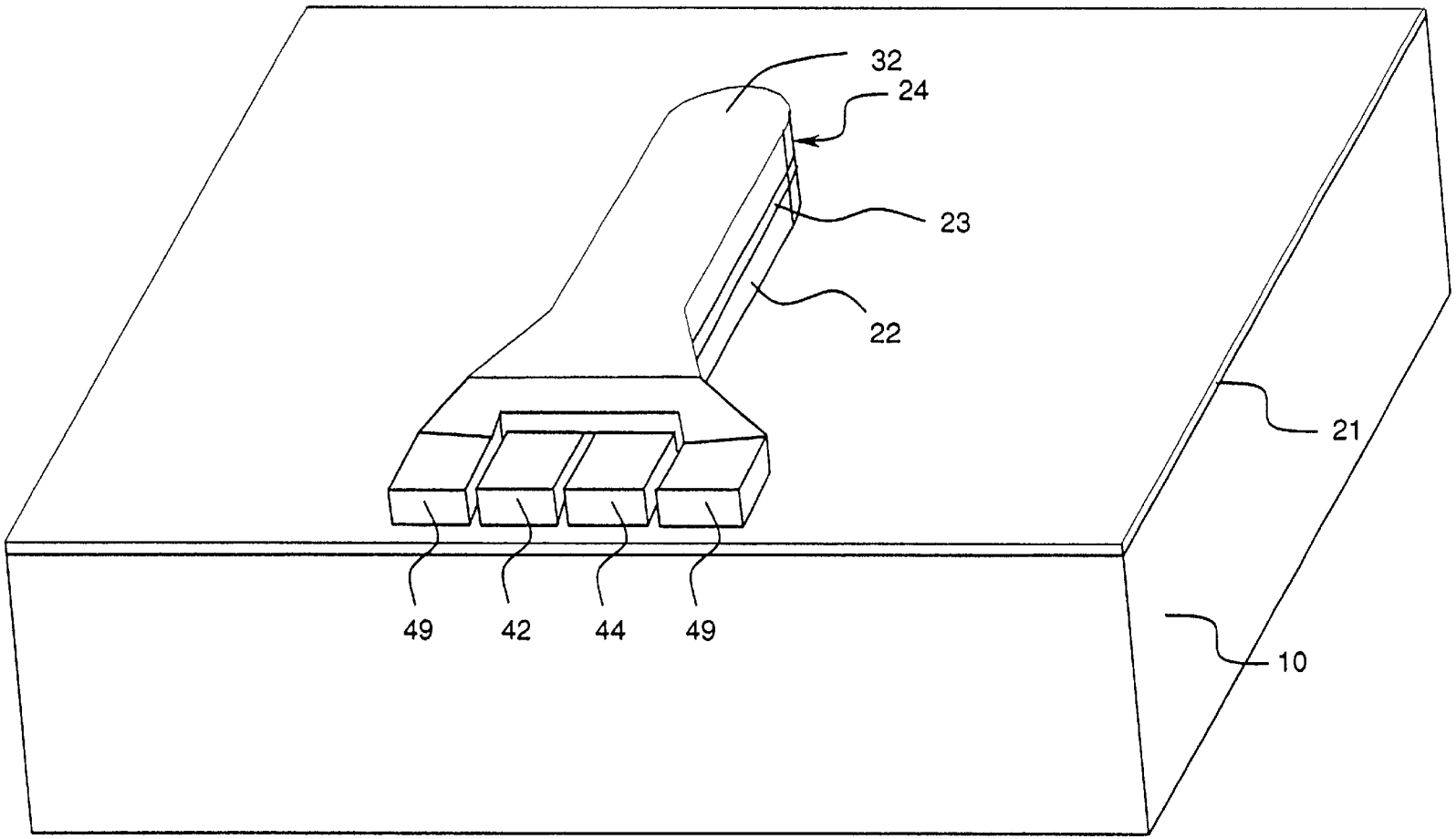
FIG. 8 is a perspective view of the next stages of the process illustrated in FIGS. 5–7 wherein a second deflector layer of the cantilevered element is formed.

FIG. 8 illustrates in perspective view a second deflector layer 24 of a cantilevered element thermal actuator. A second material having a high coefficient of thermal expansion, for example titanium aluminide, is deposited and patterned to form the second deflector layer structure. The free end tip 32 portion of the second deflector layer is labeled for reference.

Figure 9:
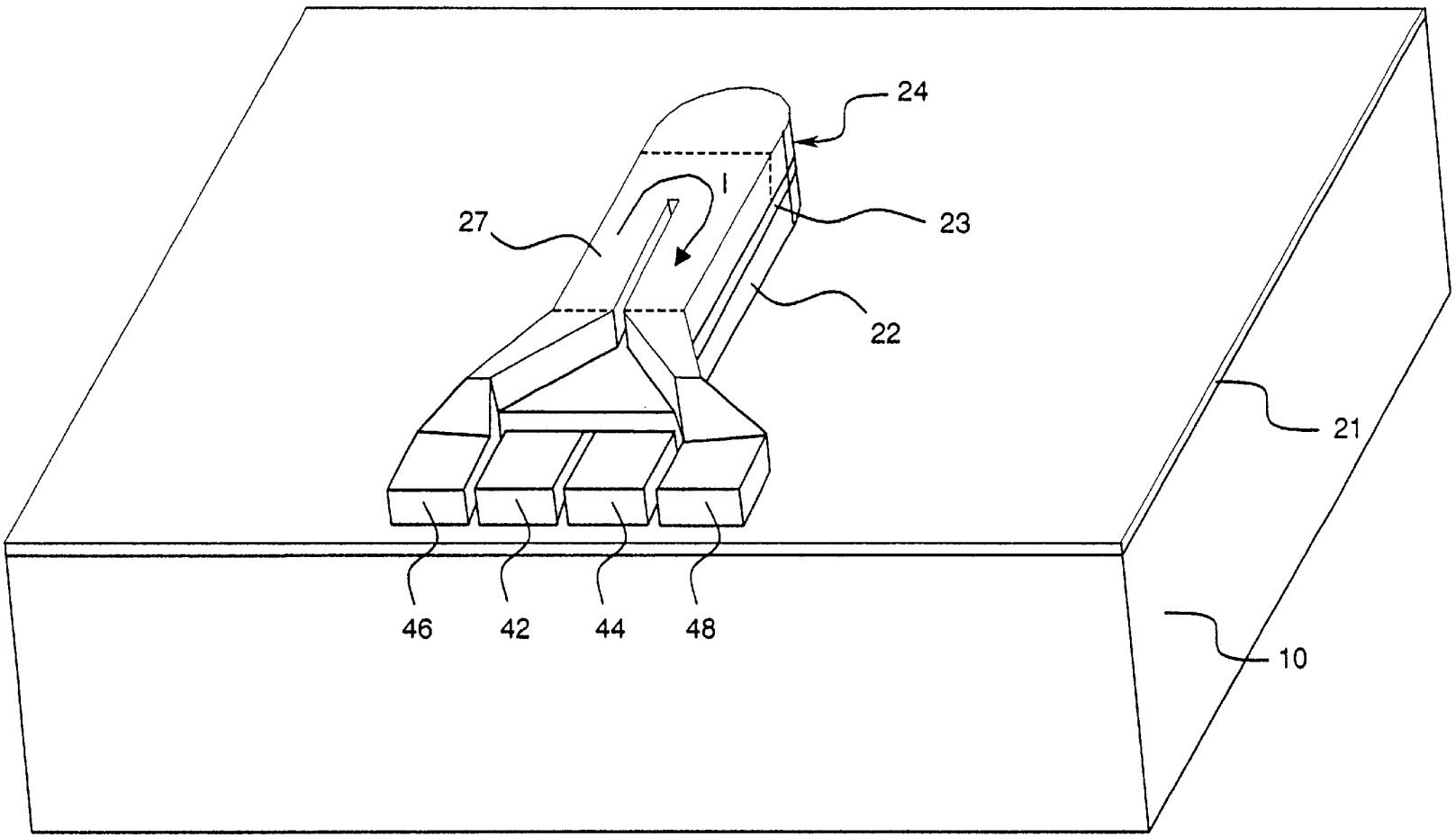
FIG. 9 is a perspective view of the next stages of the process illustrated in FIGS. 5–8 wherein a second heater resistor is patterned in the second deflector layer for some embodiments of the present inventions.

As illustrated in FIG. 9, the second deflector layer 24 may be patterned for use as a second means of applying thermo-mechanical forces to the cantilevered element. However, in some embodiments of the present inventions, the second deflector layer is a passive restorer layer, mechanically balancing the forces generated by the first deflector layer as the cantilevered element reaches thermal equilibrium. This passive, restorer layer configuration of the second deflector layer 24 is illustrated in FIG. 8. The layer is shown having electrode-like extensions 49 brought over the barrier layer 23 into contact with substrate 10 beside first electrode pair 42 and 44. Extensions 49 of layer 24 are thermal pathway leads 49 formed to make good thermal contact to substrate 10. Thermal pathway leads 49 help to remove heat from the cantilevered element 20 after an actuation. Thermal pathway effects will be discussed hereinbelow in association with FIG. 22.

In FIG. 9, the second deflector layer 24 is delineated into a second heater resistor and a second pair of addressing electrodes 46 and 48 are brought over the barrier layer 23 to contact positions on either side of the first pair of electrodes 42 and 44. Electrodes 46 and 48 may make contact with circuitry previously formed in substrate 10 or may be contacted externally by other standard electrical interconnection methods, such as tape automated bonding (TAB) or wire bonding.

Figure 10:
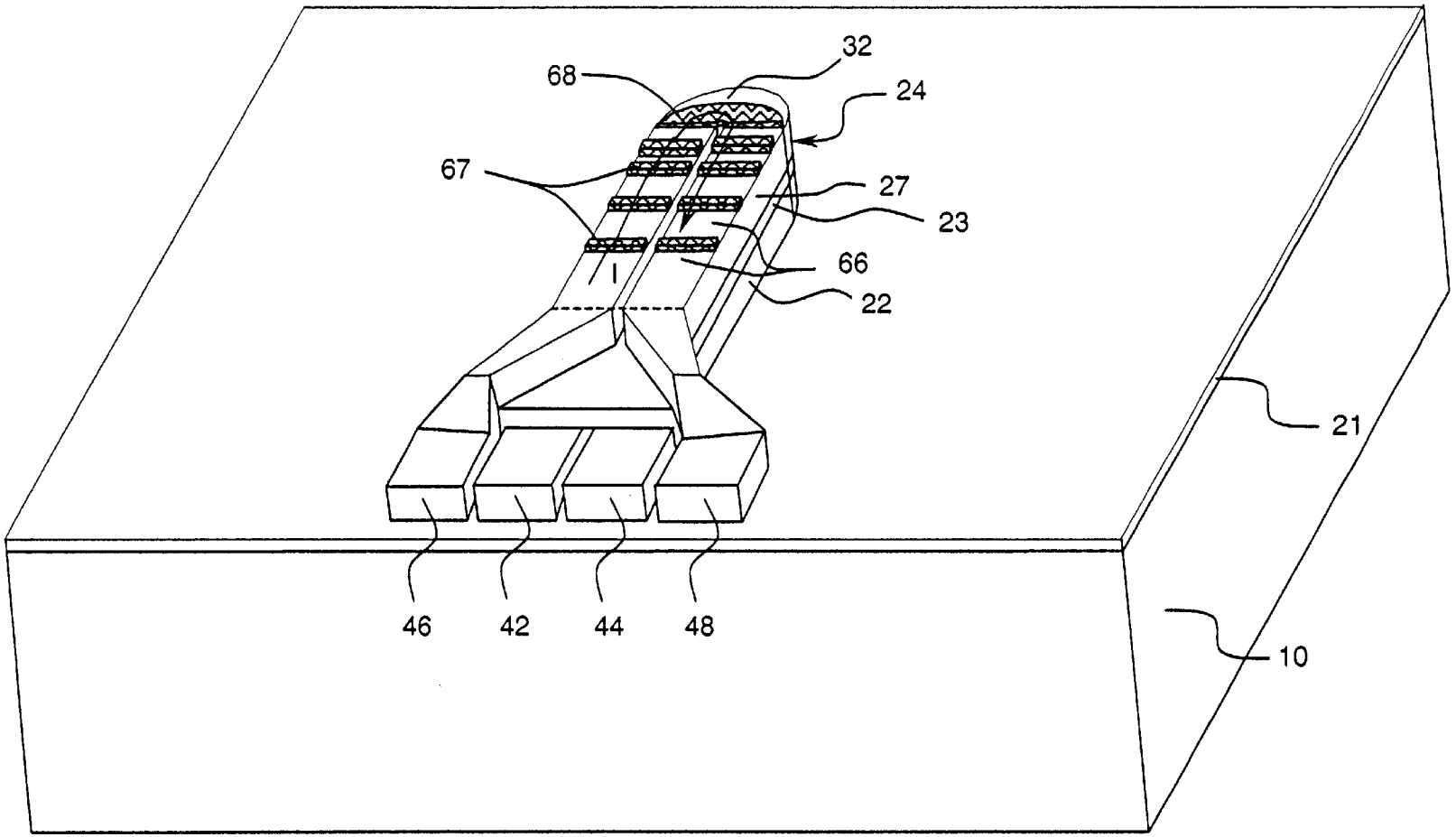
FIG. 10 is a perspective view of the next stages of the process illustrated in FIGS. 5–9 wherein a second heater resistor is completed by addition of conductive material and patterning for some embodiments of the present inventions.

FIG. 10 illustrates in perspective view a next step in the fabrication wherein a conductive material is deposited and delineated in a current shunt pattern to complete the formation of second heater resistor 27 in second deflector layer 24. Second heater resister 27 is comprised of heater resistor segments 66 formed in the second material of the second deflector layer 24, a current coupling shunt 68 which conducts current serially from input electrode 46 to input electrode 48, and current shunts 67 which modify the power density of electrical energy input to the second heater resistor. Heater resistor segments 66 and current shunts 67 are designed to establish a spatial thermal pattern in the second deflector layer. The current path is indicated by an arrow and letter "I".

An alternative approach to that illustrated in FIG. 10 would be to modify the resistivity of the second deflector layer material to make it significantly more conductive in a spatial pattern similar to the illustrated current shunt pattern. Increased conductivity may be achieved by in situ processing of the electrically resistive material forming second layer 24. Examples of in situ processing to increase conductivity include laser annealing, ion implantation through a mask, or thermal diffusion doping.

In some preferred embodiments of the present invention, the same material, for example, intermetallic titanium aluminide, is used for both second deflector layer 24 and first deflector layer 22. In this case an intermediate masking step may be needed to allow patterning of the second deflector layer 24 shape without disturbing the previously delineated first deflector layer 22 shape. Alternately, barrier layer 23 may be fabricated using a lamination of two different materials, one of which is left in place protecting electrodes 42, 44, current shunts 67 and current coupling shunt 68 while patterning second deflector layer 24, and then removed to result in the cantilever element intermediate structure illustrated in FIGS. 9 and 10.

Figure 11:
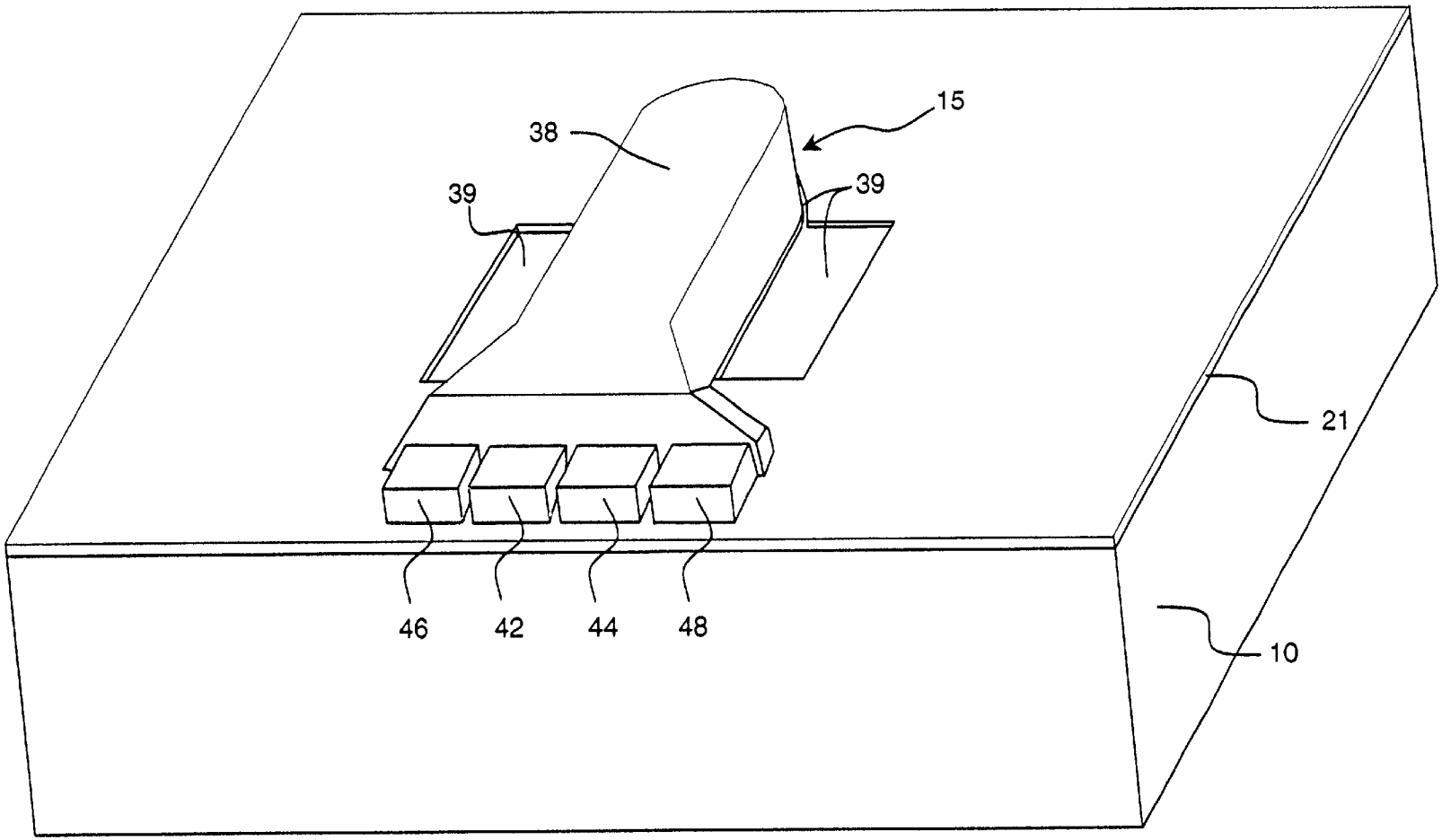
FIG. 11 is a perspective view of the next stages of the process illustrated in FIGS. 5–10 wherein a dielectric and chemical passivation layer is formed over the thermal actuator if needed for the device application, such as for a liquid drop emitter.

FIG. 11 illustrates in perspective view the addition of a passivation material overlayer 38 applied over the second deflector layer and second heater resistor for chemical and electrical protection. For applications in which the thermal actuator will not contact chemically or electrically active materials, passivation overlayer 38 may be omitted. Also, at this stage, the initial passivation layer 21 may be patterned away from clearance areas 39. Clearance areas 39 are locations where working fluid will pass from openings to be etched later in substrate 10, or are clearances needed to allow free movement of the cantilevered element of thermal actuator 15.

Figure 12:
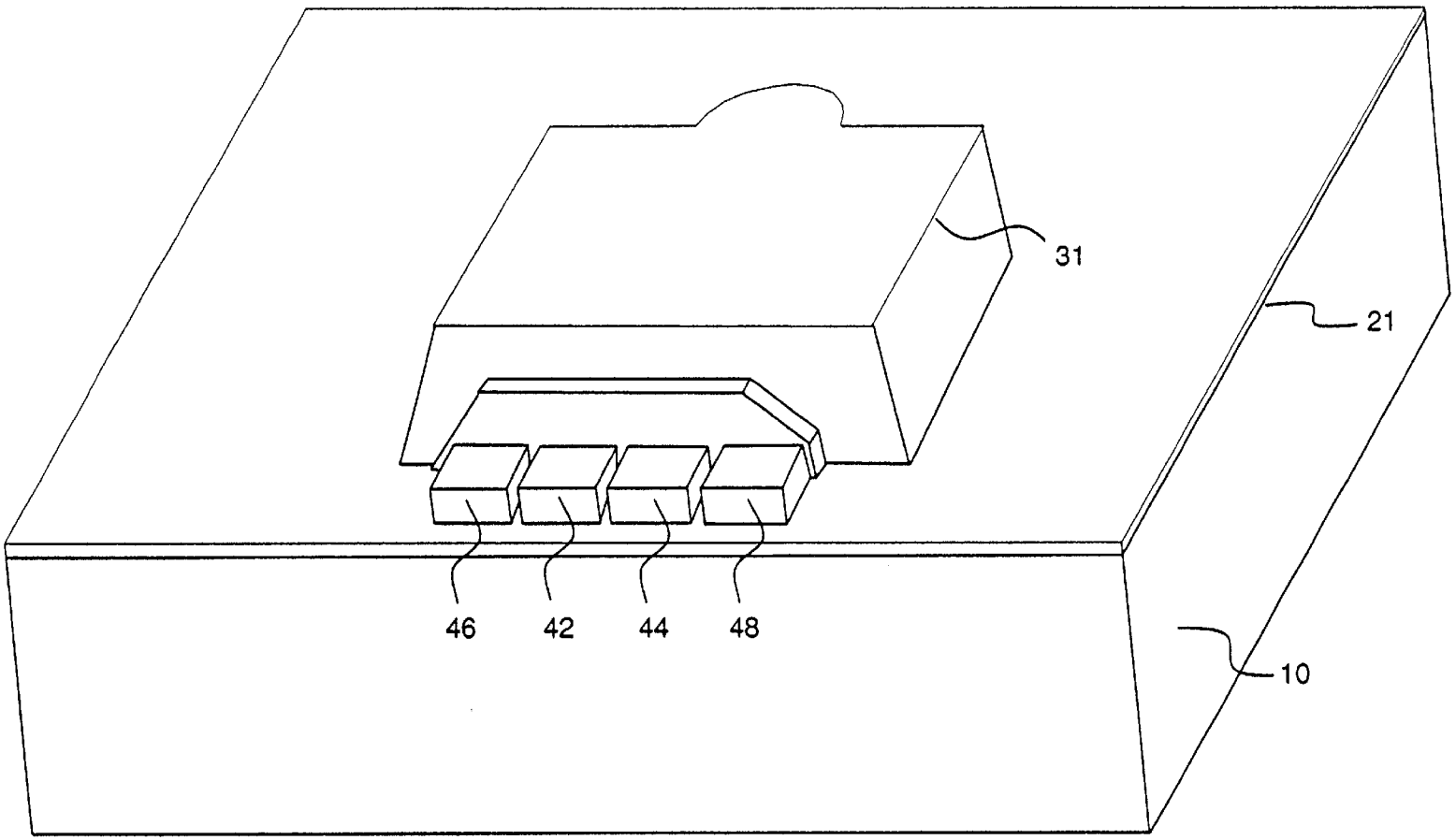
FIG. 12 is a perspective view of the next stages of the process illustrated in FIGS. 5–11 wherein a sacrificial layer in the shape of the liquid filling a chamber of a drop emitter according to the present invention is formed.

FIG. 12 shows in perspective view the addition of a sacrificial layer 31 which is formed into the shape of the interior of a chamber of a liquid drop emitter. A suitable material for this purpose is polyimide. Polyimide is applied to the device substrate in sufficient depth to also planarize the surface which has the topography of all of the layers and materials used to form the cantilevered element heretofore. Any material which can be selectively removed with respect to the adjacent materials may be used to construct sacrificial structure 31.

Figure 13:
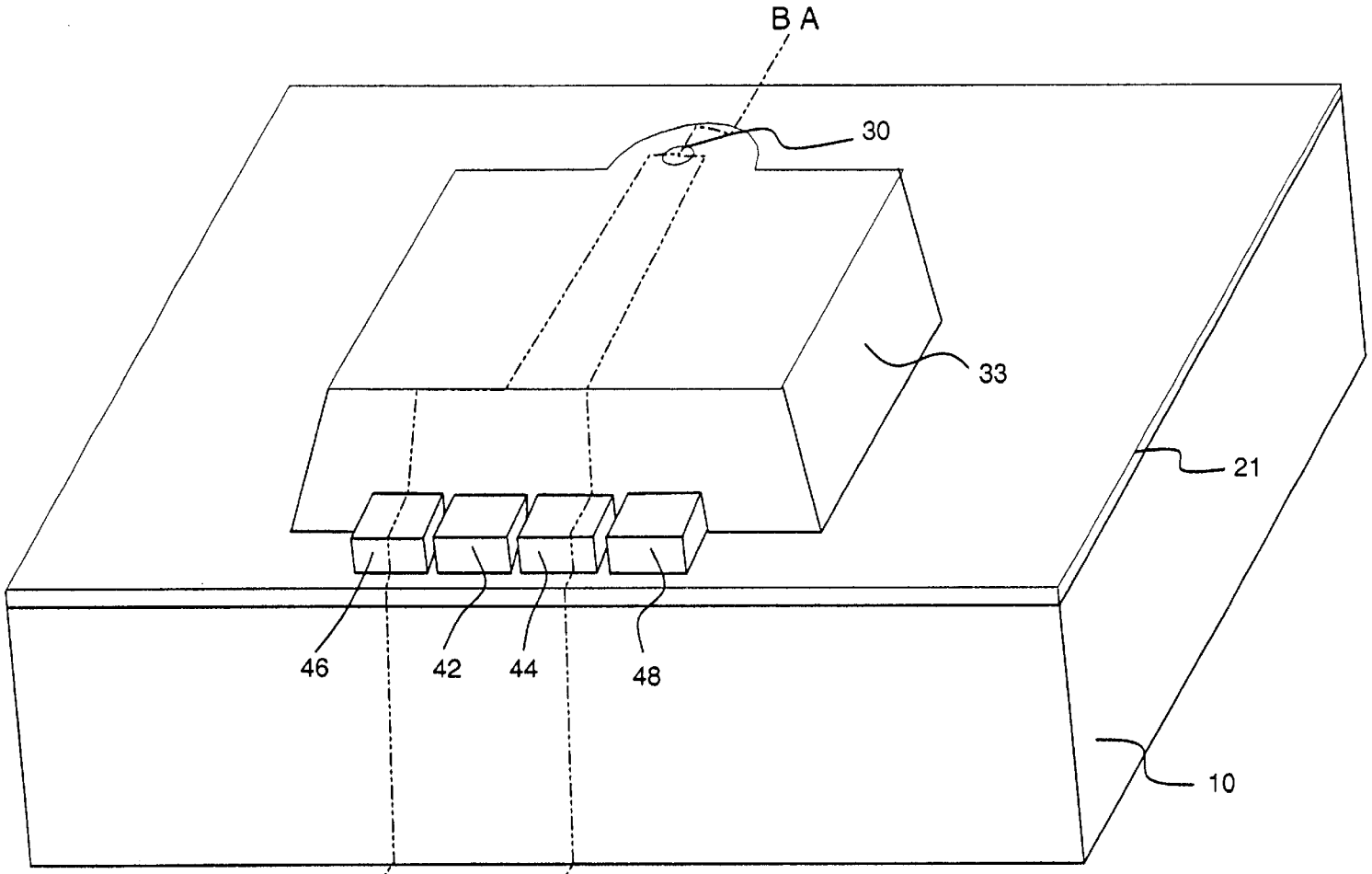
FIG. 13 is a perspective view of the next stages of the process illustrated in FIGS. 5–12 wherein a liquid chamber and nozzle of a drop emitter according to the present invention are formed.

FIG. 13 illustrates in perspective view a drop emitter liquid chamber walls and cover formed by depositing a conformal material, such as plasma deposited silicon oxide, nitride, or the like, over the sacrificial layer structure 31. This layer is patterned to form drop emitter chamber cover 33. Nozzle 30 is formed in the drop emitter chamber, communicating to the sacrificial material layer 31, which remains within the drop emitter chamber cover 33 at this stage of the fabrication sequence.

Figure 14A:
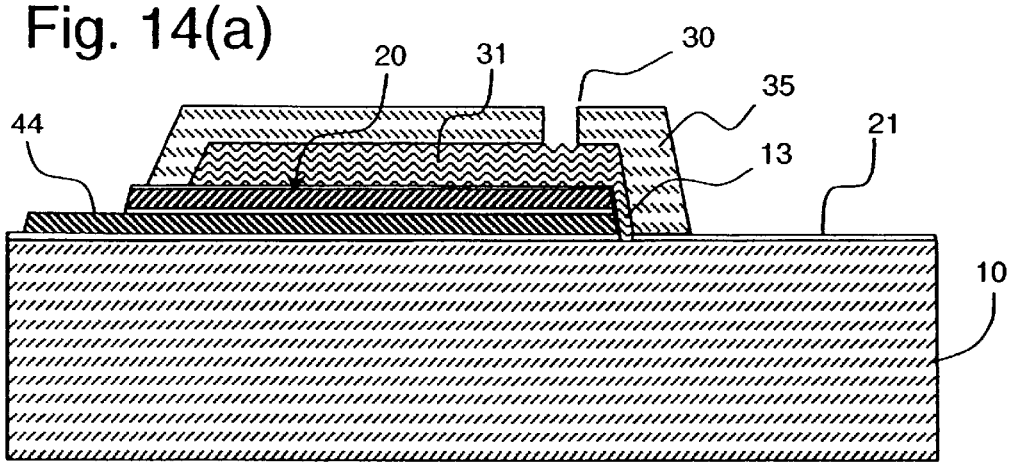
FIGS. 14(*a*)–14(*c*) are side views of the final stages of the process illustrated in FIGS. 5–13 wherein a liquid supply pathway is formed and the sacrificial layer is removed to complete a liquid drop emitter according to the present invention.
Figure 14B:
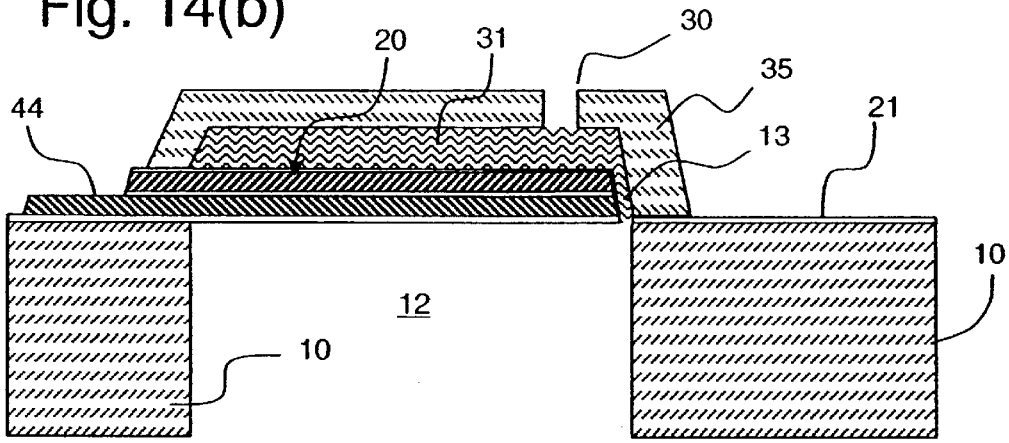
Figure 14C:
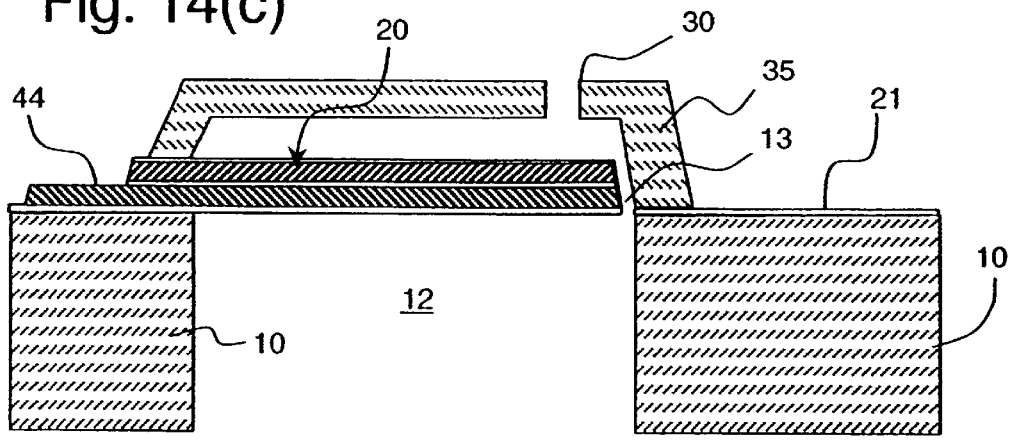

FIGS. 14*a*–14*c* show side views of the device through a section indicated as A—A in FIG. 13. In FIG. 14*a* sacrificial layer 31 is enclosed within the drop emitter chamber cover 33 except for nozzle opening 30. Also illustrated in FIG. 14*a*, substrate 10 is intact. Passivation layer 21 has been removed from the surface of substrate 10 in gap area 13 and around the periphery of the cantilevered element 20, illustrated as clearance areas 39 in FIG. 11. The removal of layer 21 in these clearance areas 39 was done at a fabrication stage before the forming of sacrificial structure 31.

In FIG. 14*b*, substrate 10 is removed beneath the cantilever element 20 and the liquid chamber areas around and beside the cantilever element 20. The removal may be done by an anisotropic etching process such as reactive ion etching, or such as orientation dependent etching for the case where the substrate used is single crystal silicon. For constructing a thermal actuator alone, the sacrificial structure and liquid chamber steps are not needed and this step of etching away substrate 10 may be used to release the cantilevered element.

In FIG. 14*c* the sacrificial material layer 31 has been removed by dry etching using oxygen and fluorine sources. The etchant gasses enter via the nozzle 30 and from the newly opened fluid supply chamber area 12, etched previously from the backside of substrate 10. This step releases the cantilevered element 20 and completes the fabrication of a liquid drop emitter structure.

Figure 15A:
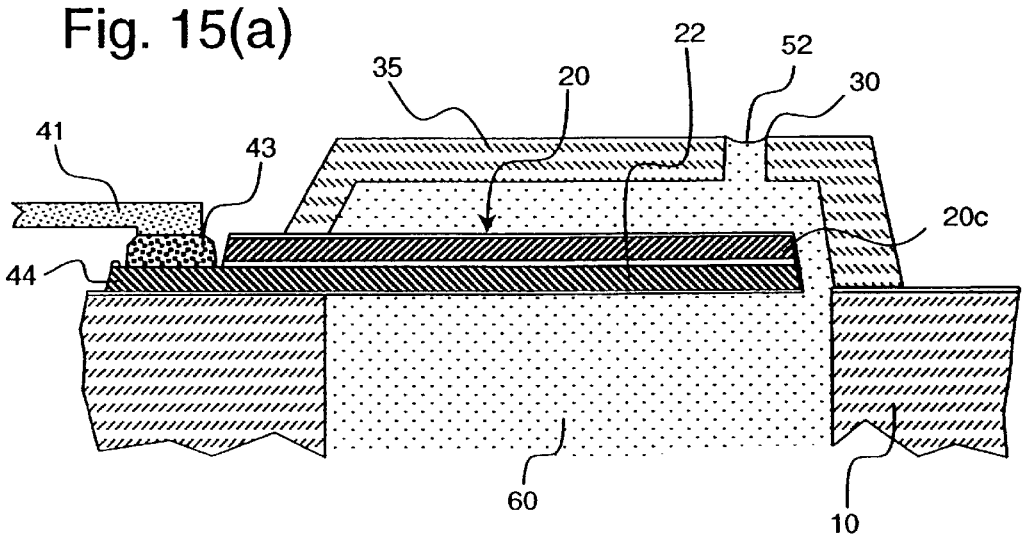
FIGS. 15(*a*)–15(*b*) are side views illustrating the application of an electrical pulse to the first pair of electrodes of a drop emitter according the present invention.
Figure 15B:
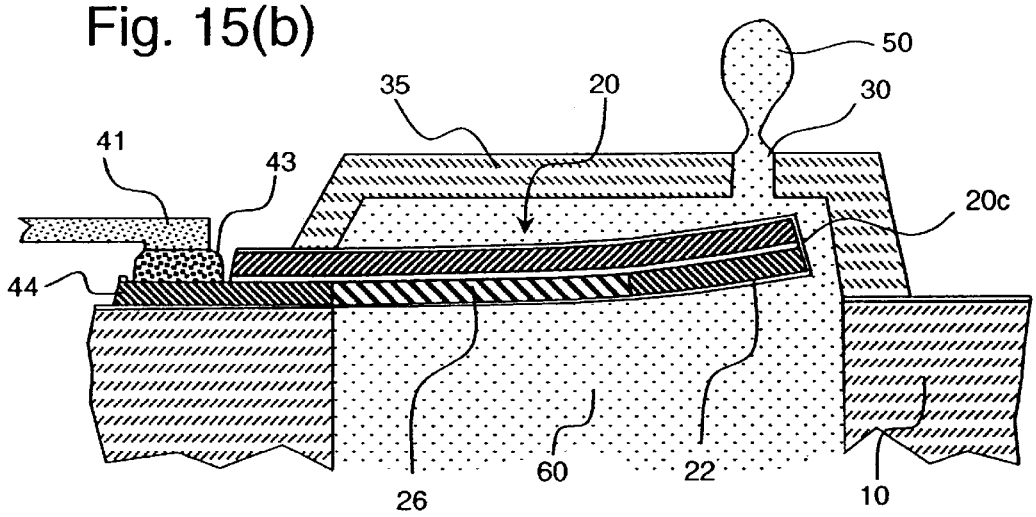

FIGS. 15*a* and 15*b* illustrate side views of a liquid drop emitter structure according to some preferred embodiments of the present invention. The side views of FIGS. 15*a* and 15*b* are formed along a line indicated as A—A in FIG. 13. FIG. 15*a* shows the cantilevered element 20 in a first position proximate to nozzle 30. Liquid meniscus 52 rests at the outer rim of nozzle 30. FIG. 15*b* illustrates the deflection of the free end 32 of the cantilevered element 20 towards nozzle 30. The upward deflection of the cantilevered element is caused by applying an electrical pulse to the first pair of electrodes 42, 44 attached to first heater resistor 26 formed in first deflector layer 22 (see also FIG. 4*b*). Rapid deflection of the cantilevered element to this second position pressurizes liquid 60, overcoming the meniscus pressure at the nozzle 30 and causing a drop 50 to be emitted.

Figure 16A:
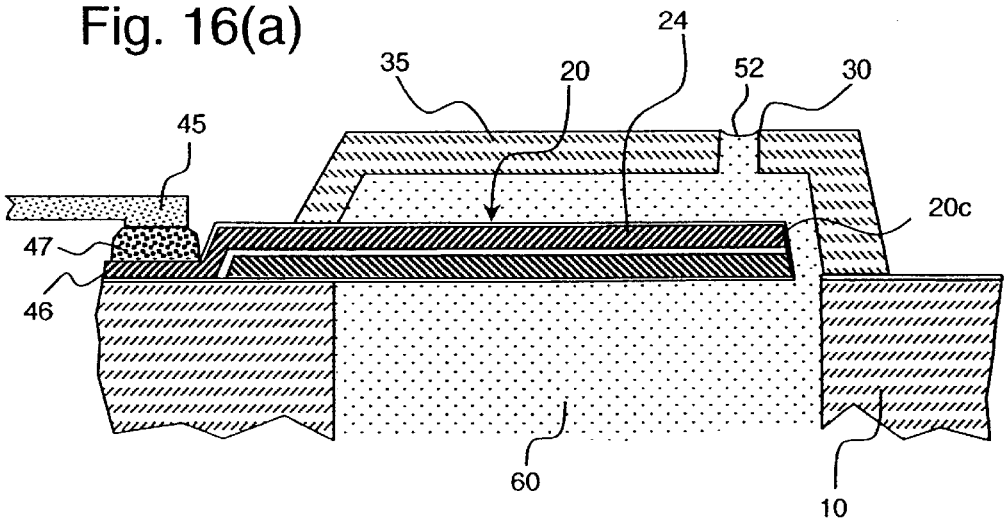
FIGS. 16(*a*)–16(*b*) are side views illustrating the application of an electrical pulse to the second pair of electrodes of a drop emitter according the present invention.
Figure 16B:
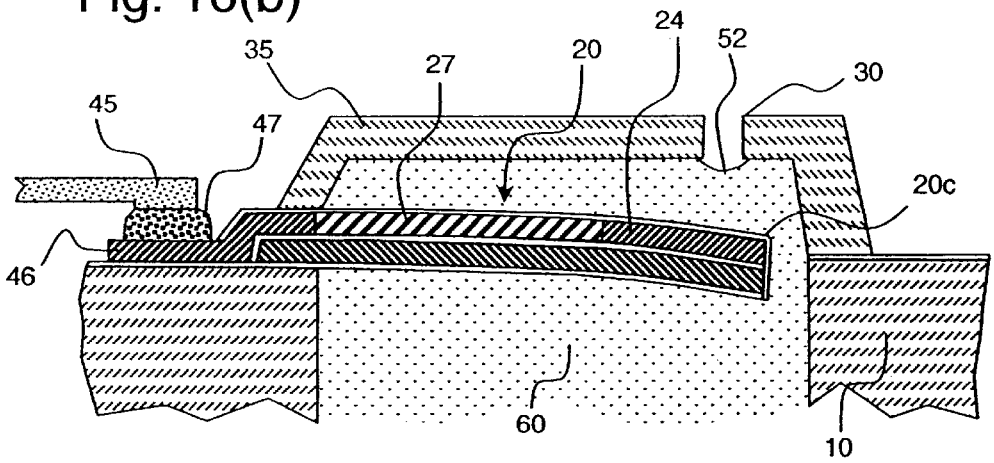

FIGS. 16*a* and 16*b* illustrate side views of a liquid drop emitter structure according to some preferred embodiments of the present invention. The side views of FIGS. 16*a* and 16*b* are formed along a line indicated as B—B in FIG. 13. FIG. 16*a* shows the cantilevered element 20 in a first position proximate to nozzle 30. Liquid meniscus 52 rests at the outer rim of nozzle 30. FIG. 16*b* illustrates the deflection of the free end tip 32 of the cantilevered element 20 away from nozzle 30. The downward deflection of the cantilevered element is caused by applying an electrical pulse to the second pair of electrodes 46,48 attached to second heater resistor 27 formed in second deflector layer 24 (see also FIG. 4*c*). Deflection of the cantilevered element to this downward position negatively pressurizes liquid 60 in the vicinity of nozzle 30, causing meniscus 52 to be retracted to a lower, inner rim area of nozzle 30.

In an operating emitter of the cantilevered element type illustrated, the quiescent first position may be a partially bent condition of the cantilevered element 20 rather than the horizontal condition illustrated FIGS. 4*a*, 15*a*, and 16*a*. The actuator may be bent upward or downward at room temperature because of internal stresses that remain after one or more microelectronic deposition or curing processes. The device may be operated at an elevated temperature for various purposes, including thermal management design and ink property control. If so, the first position may be substantially bent.

For the purposes of the description of the present invention herein, the cantilevered element will be said to be quiescent or in its first position when the free end is not significantly changing in deflected position. For ease of understanding, the first position is depicted as horizontal in FIGS. 4*a*, 15*a*, and 16*a*. However, operation of thermal actuators about a bent first position are known and anticipated by the inventors of the present invention and are fully within the scope of the present inventions.

FIGS. 5 through 14*c* illustrate a preferred fabrication sequence. However, many other construction approaches may be followed using well known microelectronic fabrication processes and materials. For the purposes of the present invention, any fabrication approach which results in a cantilevered element including a first deflection layer 22, a barrier layer 23, and, optionally, a second deflector layer 24 may be followed. These layers may also be composed of sub-layers or laminations in which case the thermo-mechanical behavior results from a summation of the properties of individual laminations. Further, in the illustrated fabrication sequence of FIGS. 5 through 14*c*, the liquid chamber cover 33 and nozzle 30 of a liquid drop emitter were formed in situ on substrate 10. Alternatively a thermal actuator could be constructed separately and bonded to a liquid chamber component to form a liquid drop emitter.

The thermo-mechanical bender portion of a cantilevered element thermal actuator is designed to have a length sufficient to result in an amount of deflection sufficient to meet the requirements of the microelectronic device application, be it a drop emitter, a switch, a valve, light deflector, or the like. The details of thermal expansion differences, stiffness, thickness and other factors associated with the layers of the thermo-mechanical bending portion are considered in determining an appropriate length for the cantilevered element.

The width of the thermo-mechanical bender portion is important in determining the force which is achievable during actuation. For most applications of thermal actuators, the actuation must move a mass and overcome counter forces. For example, when used in a liquid drop emitter, the thermal actuator must accelerate a mass of liquid and overcome backpressure forces in order to generate a pressure pulse sufficient to emit a drop. When used in switches and valves the actuator must compress materials to achieve good contact or sealing.

In general, for a given length and material layer construction, the force that may be generated is proportional to the width of the thermo-mechanical bending portion of the cantilevered element. A straightforward design for a thermo-mechanical bender is therefore a rectangular beam of width $w_0$ and length L, wherein L is selected to produce adequate actuator deflection and $w_0$ is selected to produce adequate force of actuation, for a given set of thermo-mechanical materials and layer constructions.

The inventors of the present inventions have discovered that the energy efficiency of the thermo-mechanical actuation force may be enhanced by establishing a beneficial spatial thermal pattern in the thermo-mechanical bender portion. A beneficial spatial thermal pattern is one that causes the increase in temperature, $\Delta T$, within the relevant layer or layers to be greater at the base end than at the free end of the thermo-mechanical bender portion.

The performance characteristics of a cantilevered actuator may be understood by using stationary differential Equation 1 below:

$$EI\frac{d^2y}{dx^2} = L^2 M_T(x), \tag{1}$$

where, $$I = \frac{1}{12} w_0 h^3.$$

Second order differential Equation 1 expresses the equilibrium relationship between the deflection, y(x), along the cantilever and an applied thermo-mechanical moment, $M_T(x)$, which also varies spatially as a function of the distance x, measured from the anchor location 14 of the base end of the thermo-mechanical bender portion. The distance variable x has been normalized by L, the length of the thermo-mechanical bender portion, i.e., x=1 at position L. Equation 1 may be solved for y(x) using the boundary conditions y(0)=dy(0)/dx=0.

Differential Equation 1 may be expressed as a function of an applied a spatial thermal pattern by casting the equilibrium thermo-mechanical moment and structural factors, $M_T(x)/EI$, in terms of a thermo-mechanical structure factor, c, and a temperature increase function, ΔT(x), termed herein a spatial thermal pattern:

$$\frac{M_T(x)}{EI} = c\Delta T(x), \tag{2}$$

$$\frac{d^2y}{dx^2} = L^2 c\Delta T(x), \tag{3}$$

The thermo-mechanical structure factor, c, captures the geometrical and materials properties which lead to an internal thermo-mechanical moment when the temperature of a thermo-mechanical bender is increased. An example calculation of "c" for a multi-layer beam structure will be given hereinbelow. The temperature increase has a spatial thermal pattern, as conveyed by making ΔT a function of x, i.e., ΔT(x).

Figure 17:
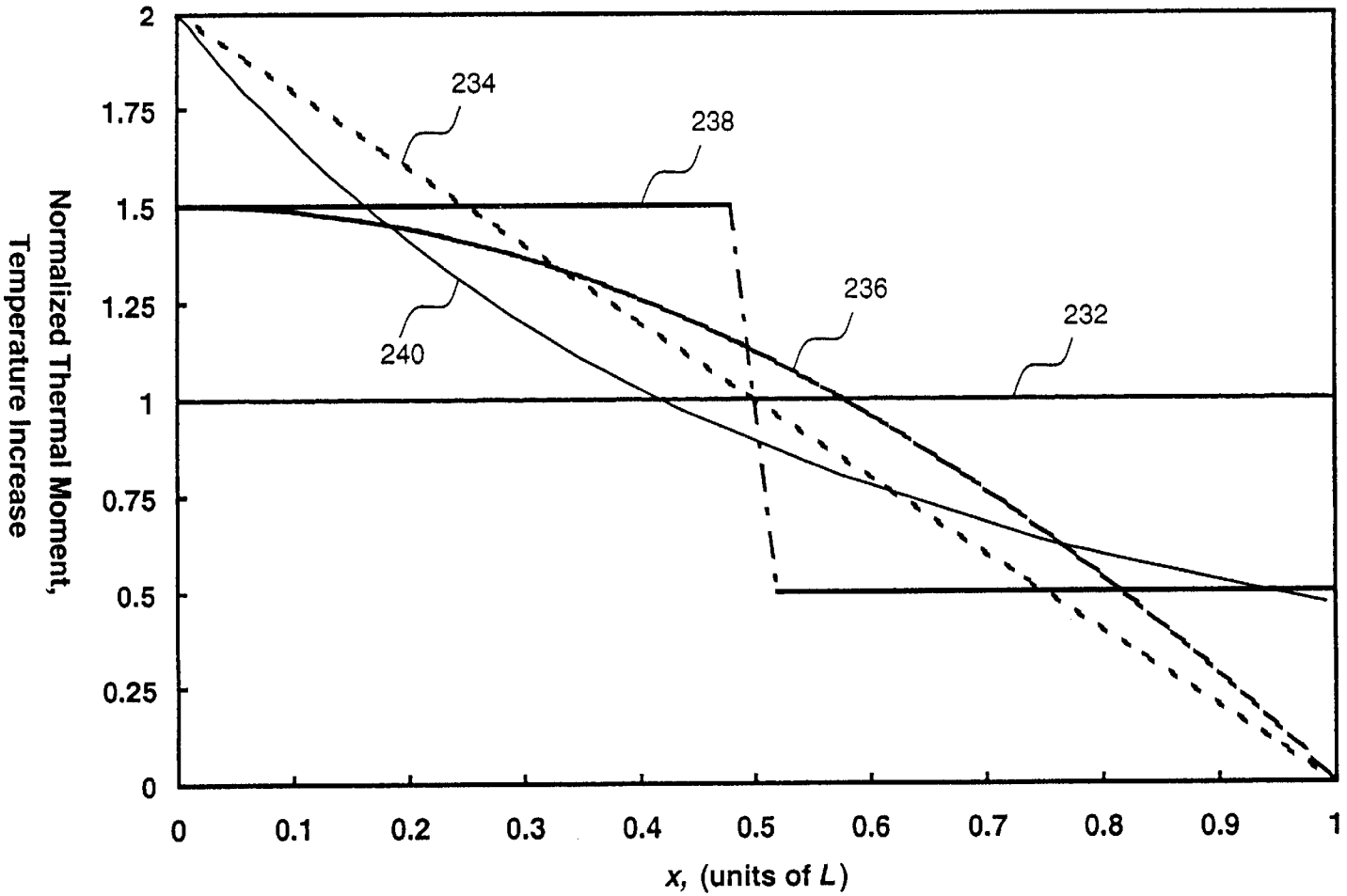
FIG. 17 illustrates several spatial thermal patterns over the thermo-mechanical bender portion causing spatial dependence of the applied thermal moments.

Several example spatial thermal patterns, ΔT(x), are plotted in FIG. 17. The plots in FIG. 17 illustrate actuation temperature increases along a rectangular thermo-mechanical bender portion wherein x=0 is at the base end and x=1 is at the free end location. The distance variable x has been normalized by the length L of the thermo-mechanical bender portion. The spatial thermal patterns are further normalized so as to all have the same average temperature increase, normalized to 1. That is, the integrals of the temperature increase profiles in FIG. 17, evaluated from x=0 to x=1, have been made equal by adjusting the maximum increase in temperature and other parameters for each spatial thermal pattern example. The amount of energy applied to the thermo-mechanical bender portion is proportional to this integral so all of the plotted spatial thermal patterns have resulted from the application of the same amount of input heat energy.

In FIG. 17, plot 232 illustrates a constant temperature increase function, plot 234 a linearly declining temperature increase function, plot 236 a quadratically declining temperature increase function, plot 238 a function in which the temperature increase declines in one step, and plot 240 an inverse-power law declining temperature increase function. The following mathematical expressions will be used to analyze the effect on the deflection of a thermo-mechanical bender portion having these spatial thermal patterns:

$$\text{Constant } \Delta T \text{ pattern: } \frac{M_T(x)}{EI} = c\Delta T_0; \tag{4}$$

$$\text{Linear } \Delta T \text{ pattern: } \frac{M_T(x)}{EI} = 2c\Delta T_0(1-x); \tag{5}$$

$$\text{Quadratic } \Delta T \text{ pattern: } \frac{M_T(x)}{EI} = \frac{3}{2}c\Delta T_0(1-x^2); \tag{6}$$

$$\text{Stepped } \Delta T \text{ pattern: } \frac{M_T(x)}{EI} = c\Delta T_0(1+\beta),\ 0 \le x \le x_s \tag{7}$$

$$\frac{M_T(x)}{EI} = c\Delta T_0\frac{(1-(1+\beta)x_s)}{(1-x_s)},\ x_s \le x \le 1;$$

$$\text{Inverse-power } \Delta T \text{ pattern: } \frac{M_T(x)}{EI} = c\Delta T_0\left[\frac{2a}{(b+x)^n}\right]. \tag{8}$$

The stepped ΔT pattern is expressed in terms of the increase in ΔT, β, over the constant case, at the base end of the thermo-mechanical bender portion, and the location, $x_s$, of the single step reduction. In order to be able to normalize a stepped reduction spatial thermal pattern to a constant case, $x_s \leqq 1/(1+\beta)$. If $x_s$ is set equal to 1/(1+β), then the temperature increase must be zero for the length of the thermo-mechanical bender outward of $x_s$. The stepped spatial thermal pattern plotted as curve 238 in FIG. 17 has the parameters β=0.5 and $x_s$=0.5.

The inverse-power law ΔT pattern is expressed in terms of shape parameters a, b, and inverse power, n. The parameter a, as a function of b and n, is determined by requiring that the average temperature increase over the thermo-mechanical bender portion be $\Delta T_0$:

$$\int_0^1 \frac{2a}{(b+x)^n}\,dx = 1, \tag{9}$$

$$\text{therefore, } 2a = \frac{(n-1)}{b^{(1-n)} - (1+b)^{(1-n)}}, \text{ for } n > 1, \text{ and,}$$

$$2a = \frac{1}{\ln\left(\frac{1+b}{b}\right)}, \text{ when } n = 1. \tag{10}$$

The inverse-power law spatial thermal pattern plotted as curve 240 in FIG. 17 has the shape parameters: n=3, b=1.62, and 2a=8.50.

The deflection of the free end of the thermo-mechanical bender portion, y(1), which results from the several different spatial thermal patterns plotted in FIG. 17, and expressed as Equations 4–8, may be understood by using Equation 3. First, considering the case of a constant temperature increase along the thermo-mechanical bender portion, Equation 4 is inserted into Equation 3. The resulting differential equation is solved for y(x) assuming boundary conditions: y(0)=dy(0)/dx=0.

$$\text{Constant } \Delta T \text{ pattern: } y_{cons}(x) = L^2 c\Delta T_0\left(\frac{x^2}{2}\right); \tag{11}$$

$$y_{cons}(1) = L^2 c\Delta T_0\left(\frac{1}{2}\right). \tag{12}$$

The value given in Equation 12 for the deflection of the free end of a thermo-mechanical bender portion when a constant thermal pattern is applied, $Y_{cons}$(1), will be used hereinbelow to normalize, for comparison purposes, the free end deflections resulting from the other spatial thermal patterns illustrated in FIG. 17.

Many spatial thermal patterns which monotonically reduce in temperature increase from the base end to the free end of the thermo-mechanical bender portion will show improved deflection of the free end as compared to a uniform temperature increase. This can be seen from Equation 3 by recognizing that the rate of change in the bending of the beam, $d^2y/dx^2$ is caused to decrease as the temperature increase decreases away from the base end. That is, from Equation 5:

$$\frac{d^2y}{dx^2} \propto \Delta T(x). \tag{13}$$

As compared to the constant temperature increase case wherein $\Delta T(x)=\Delta T_0$, a normalized, monotonically decreasing $\Delta T(x)$ will result in a larger value for the rate of change in the slope of the beam at the base end. The more the cantilevered element slope is increased nearer to the base end, the larger will be the ultimate amount of deflection of the free end. This is because the outward extent of the beam will act as a lever arm, further magnifying the amount of bending and deflection which occurs in higher temperature regions of the thermo-mechanical bending portion near the base end. A beneficial improvement in the thermo-mechanical bender portion energy efficiency will result if the base end temperature increase is substantially greater than the free end temperature increase, provided the total input energy or average temperature increase is held constant. The term substantially greater is used herein to mean at least 20% greater.

Applying added thermal energy in a spatial thermal pattern which is biased towards the free end will not enjoy the leveraging effect and will be less efficient than a constant spatial thermal pattern.

It is useful to the understanding of the present inventions to characterize thermo-mechanical bender portions that have a monotonically reducing spatial thermal pattern by calculating the normalized deflection at the free end, $\bar{y}(\mathbf{1})$. The normalized deflection at the free end, $\bar{y}(\mathbf{1})$, is calculated for an arbitrary spatial thermal pattern by first normalizing the spatial thermal pattern parameters so that the deflection may be compared in consistent fashion to a similiarly constructed thermo-mechanical bending portion subject to a uniform temperature increase. The length of and the distance along the thermo-mechanical bender portion, x, are normalized to L so that x ranges from x=0 at the anchor location 14 to x=1 at the free end location 18.

The spatial thermal pattern, $\Delta T(x)$, is normalized by requiring that the average temperature increase is $\Delta T_0$. That is, the normalized spatial thermal pattern, $\overline{\Delta T}(x)$, is formed by adjusting the pattern parameters so that $$\int_0^1 \frac{\overline{\Delta T}(x)}{\Delta T_0}\,dx = 1. \tag{14}$$

The normalized deflection at the free end, $\bar{y}(\mathbf{1})$, is then calculated by first inserting the normalized spatial thermal pattern, $\overline{\Delta T}(x)$, into differential Equation 3:

$$\frac{d^2y}{dx^2} = L^2 c\Delta T_0 \overline{\Delta T}(x). \tag{15}$$

Equation 15 is integrated twice to determine the deflection, y(x), along the thermo-mechanical bender portion. The integration solutions are subjected to the boundary conditions noted above, $y(\mathbf{0})=dy(\mathbf{0})/dx=0$. In addition, if the normalized spatial thermal pattern function $\overline{\Delta T}(x)$ has steps, i.e. discontinuities, y and dy/dx are required to be continuous at the discontinuities. y(x) is evaluated at free end location 18, x=1, and normalized by the quantity, $y_{cons}(\mathbf{1})$, the free end deflection of the constant spatial thermal pattern, given in Equation 12. The resulting quantity is the normalized deflection at the free end, $\bar{y}(\mathbf{1})$:

$$\bar{y}(1) = 2\int_0^1 \left[\int_0^{x_2} \overline{\Delta T}(x)\,dx_1\right] dx_2. \tag{16}$$

If the normalized deflection at the free end, $\bar{y}(\mathbf{1})>1$, then that spatial thermal pattern will provide more free end deflection than by applying the same energy uniformly. Such a spatial thermal pattern may be used to create a thermal actuator having more deflection for the same input of thermal energy or the same deflection with the input of less thermal energy than the comparable uniform temperature increase pattern. If, however, $\bar{y}(\mathbf{1})<1$, then that spatial thermal pattern yields less free end deflection and is disadvantaged relative to a uniform temperature increase.

The normalized deflection at the free end, $\bar{y}(\mathbf{1})$, is used herein to characterize and evaluate the contribution of an applied spatial thermal pattern to the performance of a cantilevered thermal actuator. $\bar{y}(\mathbf{1})$ may be determined for an arbitary spatial thermal pattern, $\Delta T(x)$, by using well known numerical integration methods to calculate $\overline{\Delta T}(x)$ and to evaluate Equation 16. All spatial thermal patterns which have $\bar{y}(\mathbf{1})>1$ are preferred embodiments of the present inventions.

The deflections of a rectangular thermo-mechanical bender portion subjected to the linear, quadratic, stepped and inverse-power spatial thermal patterns, given in Equations 5–8, respectively, are found in the above prescribed fashion by employing above differential Equation 16 with the boundary conditions: $y(\mathbf{0})=dy(\mathbf{0})/dx=0$. For the stepped reduction spatial thermal pattern, it is further assumed that the deflection and deflection slope are continuous at the step position, $x_s$. The deflection values of the free ends, $y(\mathbf{1})$, are then normalized to the constant thermal pattern case to calculate the normalized deflection of the free end, $\bar{y}(\mathbf{1})$.

$$\text{Linear } \Delta T \text{ pattern: } y_{lin}(x) = 2L^2 c\Delta T_0\left(x^2 - \frac{x^3}{3}\right); \tag{17}$$

$$\bar{y}_{lin}(1) = 1.33. \tag{18}$$

$$\text{Quadratic } \Delta T \text{ pattern: } y_{\text{quad}}(x) = \frac{3}{2}L^2 c\Delta T_0\left(\frac{x^2}{2} - \frac{x^4}{12}\right); \tag{19}$$

$$\bar{y}_{\text{quad}}(1) = 1.25. \tag{20}$$

$$\text{Stepped } \Delta T \text{ pattern: } y_{step}(x) = (1+\beta)L^2 c\Delta T_0\left(\frac{x^2}{2}\right),\ 0 \le x \le x_s, \tag{21}$$

$$y_{step}(x) = \frac{(1-(1+\beta)x_s)}{(1-x_s)}L^2 c\Delta T_0\left(\frac{x^2}{2}\right),\ x_s \le x \le 1$$

$$\bar{y}_{step}(1) = (1+\beta x_s), \tag{22}$$

$$\text{and for } \beta = x_s = 0.5,\ \bar{y}_{step}(1) = 1.25. \tag{23}$$

$$\text{Inverse-power } \Delta T \text{ pattern: } y_{invpr}(x) = \tag{24}$$

$$(2a)\frac{(x+b)^{(2-n)} + (n-2)b^{(1-n)}x - b^{(2-n)}}{(n-1)(n-2)}L^2 c\Delta T_0,$$

-continued $$\bar{y}_{invpr}(1) = 2(2a)\frac{(1+b)^{(2-n)} + (n-2)b^{(1-n)} - b^{(2-n)}}{(n-1)(n-2)}, \quad (25)$$

$$\text{and for } n = 3,\ b = 1.62,\ \bar{y}_{invpr}(1) = 1.24. \quad (26)$$

The expressions for the normalized free end deflection magnitudes given as Equations 18, 20, 23, and 26 above show the improvement in energy efficiency of spatial thermal patterns which result in a higher temperature increase at the base end than the free end of the thermo-mechanical bender portion. For example, if the same energy input used for a constant thermal profile actuation is applied, instead, in a linearly decreasing spatial thermal pattern, the free end deflection will be 33% greater (see Equation 18). If the energy is applied in a quadratic decreasing pattern, the deflection will be 25% greater (see Equation 20).

The step reduction spatial thermal patterns have deflection increases that depend on both the position of the temperature increase step, $x_s$, and the magnitude of the step between the base end temperature increase, $\Delta T_b$, and the free end temperature increase, $\Delta T_f$:

$$\Delta T_b - \Delta T_f = \frac{\beta}{1 - x_s}. \quad (27)$$

Figure 18:
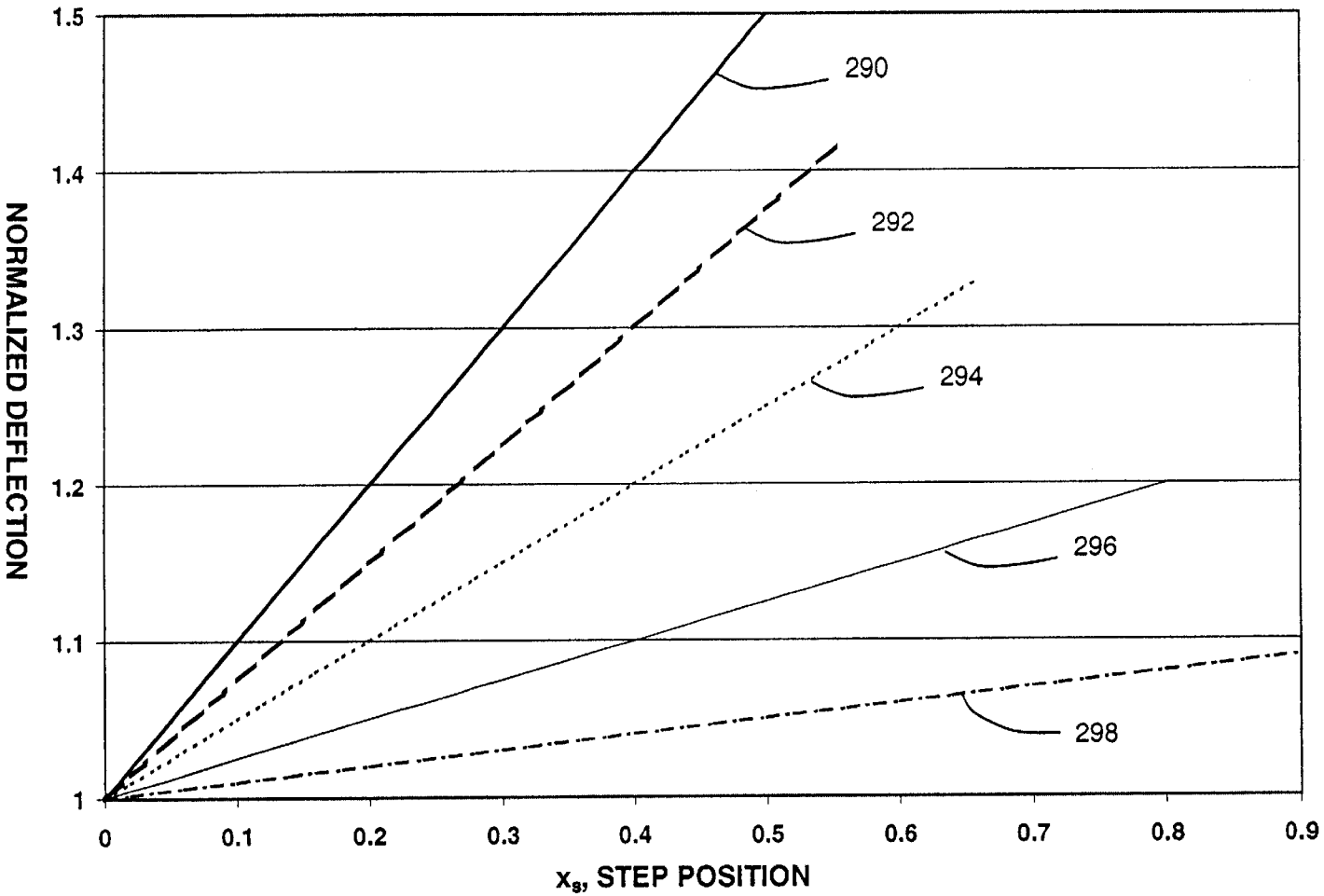
FIG. 18 plots calculations of the normalized peak deflection of a thermo-mechanical actuator having a stepped reduction, spatial thermal pattern, as a function the magnitude and position of the temperature increase reduction.

Equation 21 is plotted in FIG. 18 for several values of β as a function of the step position, $x_s$, wherein $x_s \leqq 1/(1+\beta)$. If $x_s$ is set equal to $1/(1+\beta)$, then the temperature increase must be zero for the length of the thermo-mechanical bender outward of $x_s$. In FIG. 18 plot 290 is for β=1.0; plot 292 is for β=0.75; plot 294 is for β=0.50; plot 296 is for β=0.25; and plot 298 is for β=0.10.

The value of β represents the amount of additional heating and temperature increase, over the constant thermal profile base case, that must be tolerated by the materials of the thermo-mechanical bender portion in order to realize increased deflection efficiency. If, for example, a 100% increase is viable, then a value β=1 may be used. From plot 290 in FIG. 18 it may be seen that a 50% increase in free end deflection might be realized if the maximum possible step position, $x_s$=0.5, is used. If a 50% increase in temperature increase is viable, then β=0.50, and an efficiency increase of up to 33% might be realized.

Several mathematical forms have been analyzed herein to assess thermal spatial patterns having monotonically reducing temperature increases from a base end to a free end of a thermo-mechanical bender portion. Many other spatial thermal patterns may be constructed as combinations of the specific functional forms analyzed herein. Also, spatial thermal patterns that are only slightly modified from the precise mathematical forms analyzed will have substantially the same performance characteristics in terms of the deflection of the free end. All spatial thermal patterns for the applied heat pulse which cause normalized deflections of the free end values, $\bar{y}(1)>1.0$, are anticipated as preferred embodiments of the present inventions.

Additional features of the present inventions arise from the design, materials, and construction of the multi-layered thermo-mechanical bender portion illustrated previously in FIGS. 4*a*–16*b*.

The present inventions include apparatus to apply a heat pulse having a spatial thermal pattern to the thermo-mechanical bender portion. Any means which can generate and transfer heat energy in a spatial pattern may be considered. Appropriate means may include projecting a light energy pattern onto the thermo-mechanical bender portion or coupling an rf energy pattern to the thermo-mechanical bender. Such spatial thermal patterns may be mediated by a special layer applied to the thermo-mechanical bender portion, for example a light absorbing and reflecting pattern to receive light energy or a conductor pattern to couple rf energy.

Figure 19A:
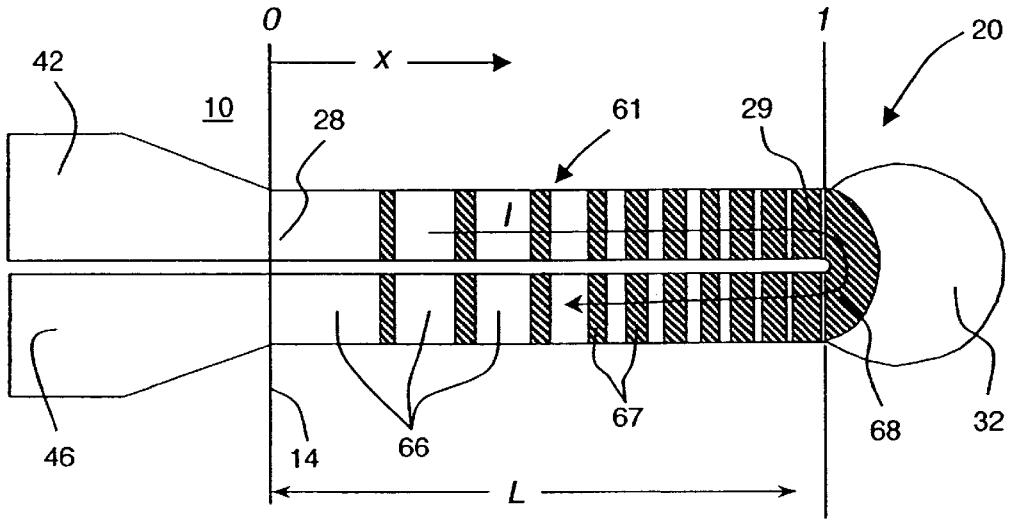
FIGS. 19(*a*) and 19(*b*) are a plan view and temperature increase plot, respectively, illustrating a heater resistor having a spatial thermal pattern according to the present inventions.
Figure 19B:
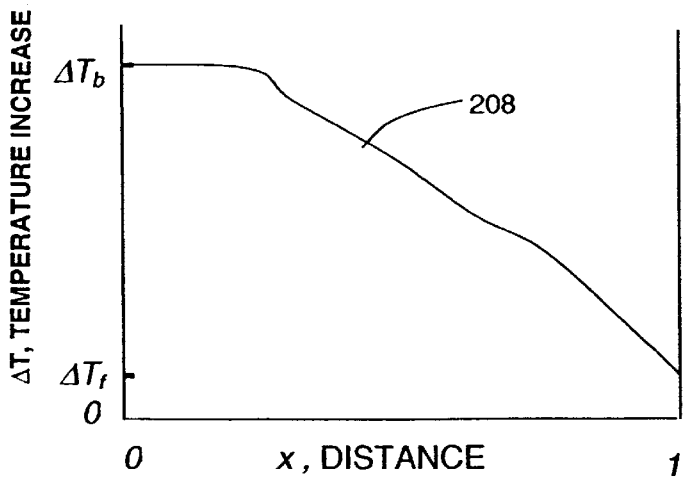

Preferred embodiments of the present inventions utilize electrical resistance apparatus to apply heat pulses having a spatial thermal pattern to the thermo-mechanical bender portion when pulsed with electrical pulses. FIG. 19*a* illustrates a resistor pattern 61 in the area of the thermo-mechanical bender portion which will generate a spatial thermal pattern according to the present inventions. Resistor pattern 61 is comprised of two parallel thin film resistors joined serially by current coupler shunt 68 and overlaid with a pattern of current shunts 67 that result in a series of smaller resistor segments 66. The function of current shunts 67 is to reduce the electrical power density, and hence the Joule heating, in the areas of the current shunts. When energized with an electrical pulse, resistor pattern 61 will set up a spatial pattern of Joule heat energy, which, in turn will cause a spatial thermal pattern as schematically illustrated in FIG. 19*b*. The illustrated spatial thermal pattern causes the highest temperature increase $\Delta T_b$ to occur at the base end and then a monotonically decreasing temperature increase to the free end temperature increase, $\Delta T_f$.

Figure 20:
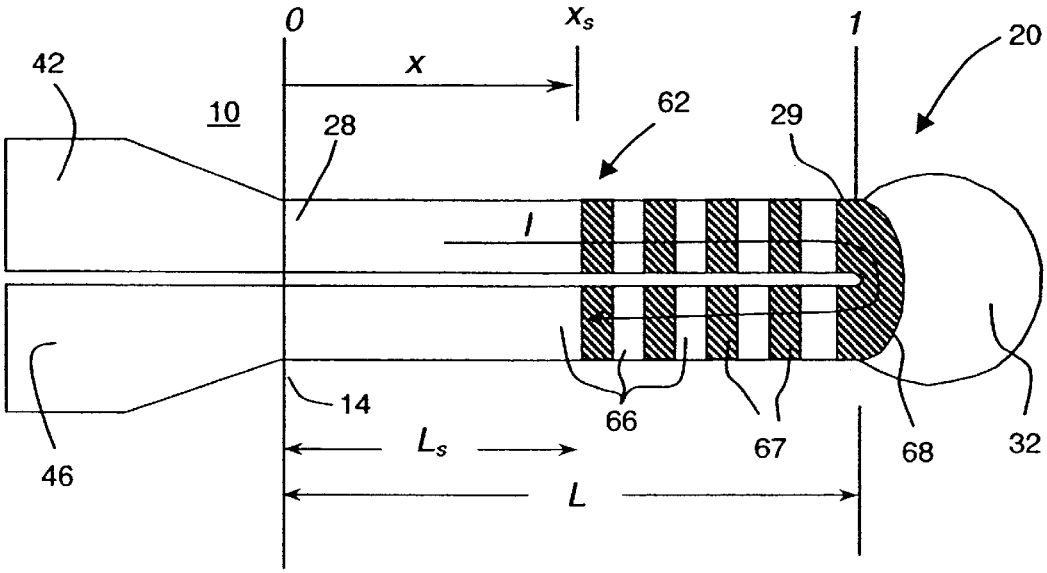
FIGS. 20(*a*) and 20(*b*) are a plan view and temperature increase plot, respectively, illustrating a heater resistor having a spatial thermal pattern having a stepped reduction in increase temperature according to the present inventions.
Figure 20B:
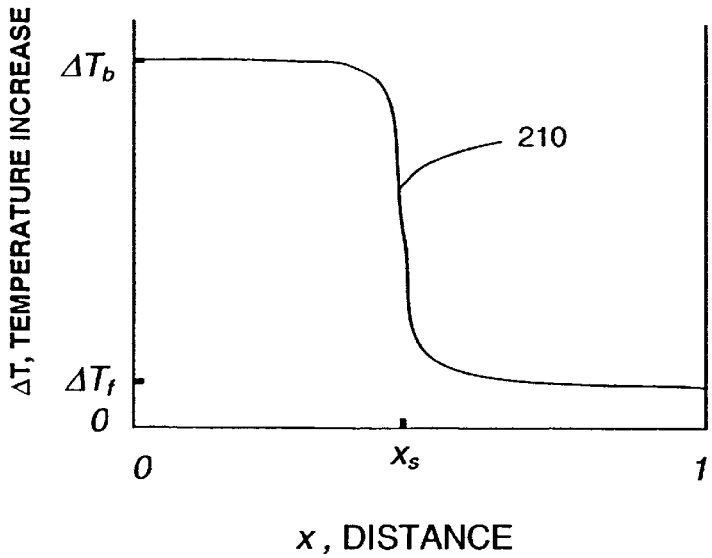

FIG. 20*a* illustrates a resistor pattern 62 in the area of the thermo-mechanical bender portion which will generate another spatial thermal pattern according to the present inventions. Resistor pattern 61 is comprised of two parallel thin film resistors joined serially by current coupler shunt 68 and overlaid with a pattern of current shunts 67 that result in a series of smaller resistor segments 66. When energized with an electrical pulse, resistor pattern 61 will set up a stepped spatial pattern of applied Joule heat energy, which, in turn will cause a stepped spatial thermal pattern as schematically illustrated in FIG. 20*b*. The illustrated stepped spatial thermal pattern causes the highest temperature increase $\Delta T_b$ to occur at the base end and then, at $x=x_s$, an abrupt drop in the temperature increase to the free end temperature increase, $\Delta T_f$.

Resistor patterns 61 and 62 may be formed in either the first or the second deflector layers of the thermo-mechanical bender portion. Alternatively, a separate thin film heater resistor may be constructed in additional layers which are in good thermal contact with either deflector layer. Current shunt areas may be formed in several manners. A good conductor material may be deposited and patterned in a current shunt pattern over an underlying thin film resistor. The electrical current will leave the underlying resistor layer and pass through the conducting material, thereby greatly reducing the local Joule heating.

Alternatively, the conductivity of a thin film resistor material may be modified locally by an in situ process such as laser annealing, ion implantation, or thermal diffusion of a dopant material. The conductivity of a thin film resistor material may depend on factors such as crystalline structure, chemical stoichiometry, or the presence of dopant impurities. Current shunt areas may be formed as localized areas of high conductivity within a thin film resistor layer utilizing well known thermal and dopant techniques common to semiconductor manufacturing processes.

Figure 21:
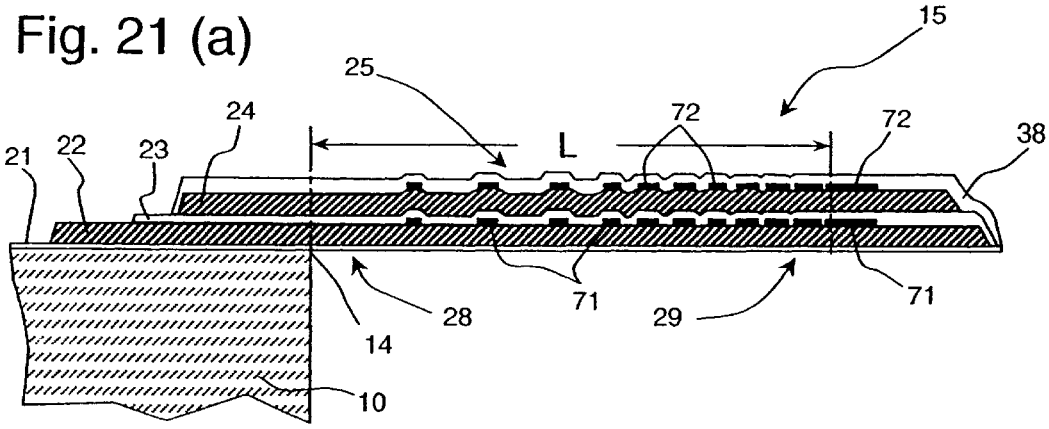
FIGS. 21(*a*)–21(*c*) are side views illustrating several apparatus for applying heat pulses having a spatial thermal pattern.
Figure 21:
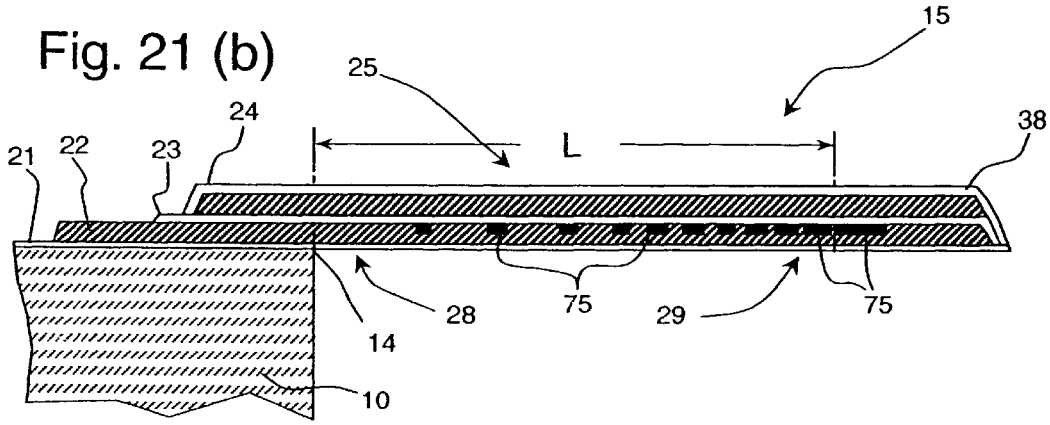
Figure 21:
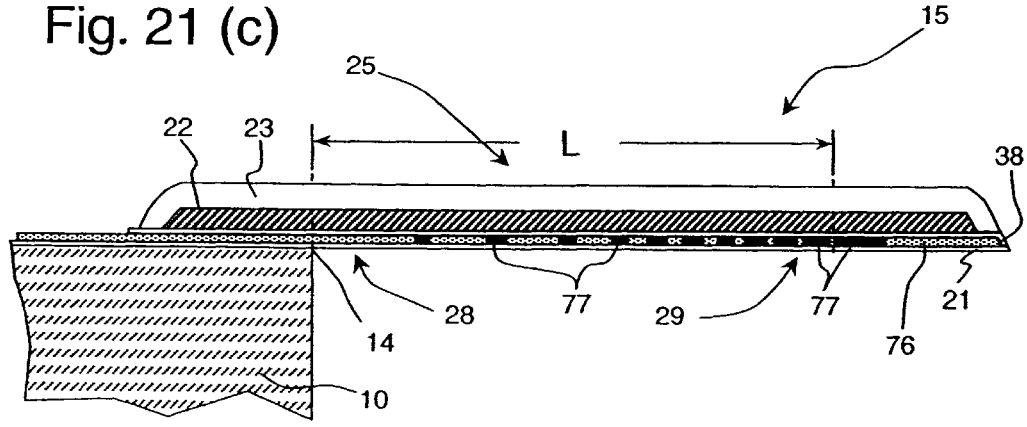

FIGS. 21*a*–21*c* illustrate in side view several alternatives to forming apparatus for applying heat pulses having spatial thermal patterns using thin film resistor materials and fabrication processes. FIG. 21*a* illustrates a thermo-mechanical bender portion formed with electrically resistive first deflector layer 22 and electrically resistive second deflector layer 24. A patterned conductive material is formed over first deflector layer 22 to create a first current shunt pattern 71. A patterned conductive material is also formed over the second deflector layer 24 to create a second current shunt pattern 72.

FIG. 21*b* illustrates a thermo-mechanical bender portion formed with a electrically resistive first deflector layer 22 and second deflector layer 24 configured as a passive restorer layer. A current shunt pattern 75 is formed in first deflector layer 22 by an insitu process which locally increases the conductivity of the first deflector layer material.

FIG. 21*c* illustrates a thermo-mechanical bender portion formed with a first deflector layer 22 and a low thermal expansion material layer 23. A thin film resistor structure is formed in a resistor layer 76 in good thermal contact with first deflector layer 22. A current shunt pattern 77 is formed in resistor layer 76 by an insitu process which locally increases the conductivity of the resistor layer material. Thin film resistor layer 76 is electrically isolated from first deflector layer 22 by a thin passivation layer 38.

Some spatial patterning of the Joule heating of a thin film resistor may also be accomplished by varying the resistor material thickness in a desired pattern. The current density, hence the Joule heating, will be inversely proportional to the layer thickness. A beneficial spatial thermal pattern can be set-up in the thermo-mechanical bender portion by forming an adjacent thin film heater resistor to be thinnest at the base end and increasing in thickness towards the free end.

Figure 22:
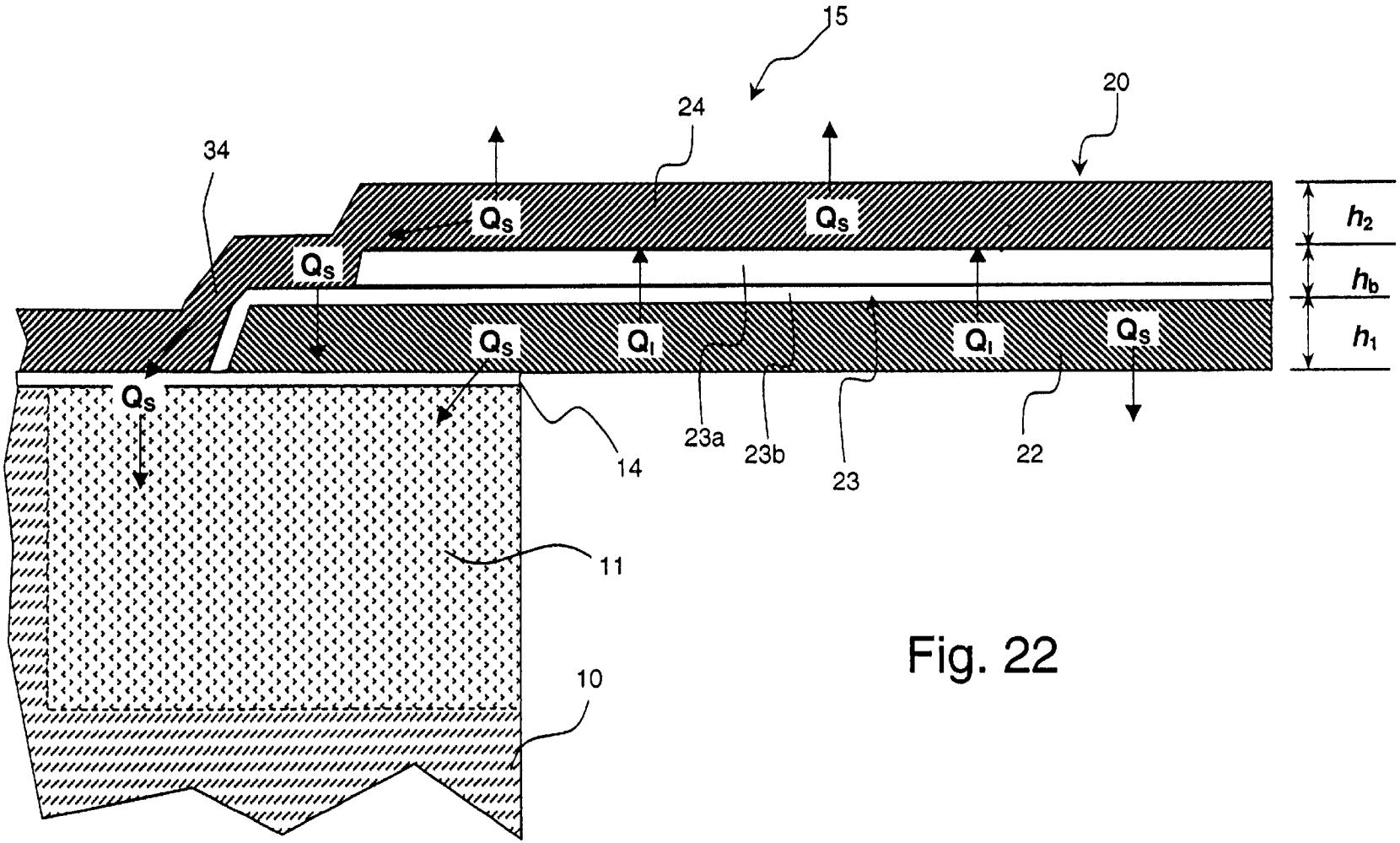
FIGS. 22 is a side view illustrating heat flows within and out of a cantilevered element according to the present inventions.

The flow of heat within cantilevered element 20 is a primary physical process underlying some of the present inventions. FIG. 22 illustrates heat flows by means of arrows designating internal heat flow, $Q_I$, and flow to the surroundings, $Q_S$. Cantilevered element 20 bends, deflecting free end 32, because first deflector layer 22 is made to elongate with respect to second deflector layer 24 by the addition of a heat pulse to first deflector layer 22, or vice versa. In general, thermal actuators of the cantilever configuration may be designed to have large differences in the coefficients of thermal expansion at a uniform operating temperature, to operate with a large temperature differential within the actuator, or some combination of both.

Embodiments of the present inventions which employ first and second deflector layers with an interposed thin thermal barrier layer are designed to utilize and maximize an internal temperature differential set up between the first deflector layer 22 and second deflector layer 24. Such structures will be termed tri-layer thermal actuators herein to distinguish them from bi-layer thermal actuators which employ only one elongating deflector layer and a second, low thermal expansion coefficient, layer. Bi-layer thermal actuators operate primarily on layer material differences rather than brief temperature differentials.

In preferred tri-layer embodiments, the first deflector layer 22 and second deflector layer 24 are constructed using materials having substantially equal coefficients of thermal expansion over the temperature range of operation of the thermal actuator. Therefore, maximum actuator deflection occurs when the maximum temperature difference between the first deflector layer 22 and second deflector layer 24 is achieved. Restoration of the actuator to a first or nominal position then will occur when the temperature equilibrates among first deflector layer 22, second deflector layer 24 and barrier layer 23. The temperature equilibration process is mediated by the characteristics of the barrier layer 23, primarily its thickness, Young's modulus, coefficient of thermal expansion and thermal conductivity.

The temperature equilibration process may be allowed to proceed passively or heat may be added to the cooler layer. For example, if first deflector layer 22 is heated first to cause a desired deflection, then second deflector layer 24 may be heated subsequently to bring the overall cantilevered element into thermal equilibrium more quickly. Depending on the application of the thermal actuator, it may be more desirable to restore the cantilevered element to the first position even though the resulting temperature at equilibrium will be higher and it will take longer for the thermal actuator to return to an initial starting temperature. A cantilevered multi-layer structure comprised of k layers having different materials properties and thicknesses, generally assumes a parabolic arc shape at an elevated uniform temperature as is expressed by above Equation 11. The thermo-mechanical structure factor, c, in Equation 11 captures the properties of the layers of the thermo-mechanical bender portion of the cantilever element. c is given by:

$$c = \frac{\dfrac{\displaystyle\sum_{k=1}^{N} \frac{E_k}{1-\sigma_k^2}\left(\frac{y_k^2 - y_{k-1}^2}{2}\right)}{\displaystyle\sum_{k=1}^{N} \frac{E_k}{1-\sigma_k^2}(y_k - y_{k-1})} \displaystyle\sum_{k=1}^{2} \frac{E_k \alpha_k}{1-\sigma_k}(y_k - h_{k-1}) - \sum_{k=1}^{N} \frac{E_k \alpha_k}{1-\sigma_k}\left(\frac{y_k^2 - y_{k-1}^2}{2}\right)}{\dfrac{\left(\displaystyle\sum_{k=1}^{N} \frac{E_k}{1-\sigma_k^2}(y_k - y_{k-1})\right)\left(\displaystyle\sum_{k=1}^{N} \frac{E_k}{1-\sigma_k^2}\left(\frac{y_k^3 - y_{k-1}^3}{3}\right)\right) - \left(\displaystyle\sum_{k=1}^{N} \frac{E_k}{1-\sigma_k^2}\left(\frac{y_k^2 - y_{k-1}^2}{2}\right)\right)^2}{\displaystyle\sum_{k=1}^{N} \frac{E_k}{1-\sigma_k^2}(y_k - y_{k-1})}}, \tag{28}$$

where $y_0=0$, $$y_k = \sum_{j=1}^{k} h_j,$$

and $E_k$, $h_k$, $\sigma_k$ and $\alpha_k$ are the Young's modulus, thickness, Poisson's ratio and coefficient to thermal expansion, respectively, of the $k^{th}$ layer.

The present inventions of the tri-layer type are based on the formation of first and second heater resistor portions to heat first and second deflection layers, thereby setting up the temperature differences, $\Delta T$, which give rise to cantilever bending. For the purposes of the present inventions, it is desirable that the second deflector layer 24 mechanically balance the first deflector layer 22 when internal thermal equilibrium is reached following a heat pulse which initially heats first deflector layer 22. Mechanical balance at thermal equilibrium is achieved by the design of the thickness and the materials properties of the layers of the cantilevered element, especially the coefficients of thermal expansion and Young's moduli. If any of the first deflector layer 22, barrier layer 23 or second deflector layer 24 are composed of sub-layer laminations, then the relevant properties are the effective values of the composite layer.

The present inventions may be understood by considering the conditions necessary for a zero net deflection, $y(x,\Delta T)=0$, for any elevated, but uniform, temperature of the cantilevered element, $\Delta T\neq 0$. From Equation 11 it is seen that this condition requires that the thermo-mechanical structure factor c=0. Any non-trivial combination of layer material properties and thicknesses which results in the thermo-mechanical structure factor c=0, Equation 28, will enable practice of the present inventions. That is, a cantilever design having c=0 can be activated by setting up temporal temperature gradients among layers, causing a temporal deflection of the cantilever. Then, as the layers of the cantilever approach a uniform temperature via thermal conduction, the cantilever will be restored to an undeflected position, because the equilibrium thermal expansion effects have been balanced by design.

For the case of a tri-layer cantilever, k=3 in Equation 28, and with the simplifying assumption that the Poisson's ratio is the same for all three material layers, the thermo-mechanical structure factor c can be shown to be proportional the following quantity:

$$c \propto \frac{1}{G}\left\{E_1(\alpha-\alpha_1)\left[\left(\frac{h_b}{2}\right)^2-\left(\frac{h_b}{2}+h_1\right)^2\right]+E_2(\alpha-\alpha_2)\left[\left(\frac{h_b}{2}+h_2\right)^2-\left(\frac{h_b}{2}\right)^2\right]\right\}, \text{ where} \tag{29}$$

$$\alpha=\frac{E_1\alpha_1h_1+E_b\alpha_bh_b+E_2\alpha_2h_2}{E_1h_1+E_bh_b+E_2h_2}. \tag{30}$$

The subscripts 1, b and 2 refer to the first deflector, barrier and second deflector layers, respectively. $E_k$, $\alpha_k$, and $h_k$ (k=1, b, or 2) are the Young's modulus, coefficient of thermal expansion and thickness, respectively, for the $k^{th}$ layer. The parameter G is a function of the elastic parameters and dimensions of the various layers and is always a positive quantity. Exploration of the parameter G is not needed for determining when the tri-layer beam could have a net zero deflection at an elevated temperature for the purpose of understanding the present inventions.

Examining Equation 29, the condition c=0 occurs when:

$$E_1(\alpha-\alpha_1)\left[\left(\frac{h_b}{2}\right)^2-\left(\frac{h_b}{2}+h_1\right)^2\right]=E_2(\alpha-\alpha_2)\left[\left(\frac{h_b}{2}\right)^2-\left(\frac{h_b}{2}+h_2\right)^2\right]. \tag{31}$$

For the special case when layer thickness, $h_1=h_2$ coefficients of thermal expansion, $\alpha_1=\alpha_2$, and Young's moduli, $E_1=E_2$, the quantity c is zero and there is zero net deflection, even at an elevated temperature, i.e. $\Delta T\neq 0$.

It may be understood from Equation 31 that if the second deflector layer 24 material is the same as the first deflector layer 22 material, then the tri-layer structure will have a net zero deflection if the thickness $h_1$ of first deflector layer 22 is substantially equal to the thickness $h_2$ of second deflector layer 24.

It may also be understood from Equation 31 there are many other combinations of the parameters for the second deflector layer 24 and barrier layer 23 which may be selected to provide a net zero deflection for a given first deflector layer 22. For example, some variation in second deflector layer 24 thickness, Young's modulus, or both, may be used to compensate for different coefficients of thermal expansion between second deflector layer 24 and first deflector layer 22 materials.

All of the combinations of the layer parameters captured in Equations 28–32 that lead to a net zero deflection for a tri-layer or more complex multi-layer cantilevered structure, at an elevated temperature $\Delta T$, are anticipated by the inventors of the present inventions as viable embodiments of the present inventions.

Returning to FIG. 22, the internal heat flows $Q_I$ are driven by the temperature differential among layers. For the purpose of understanding the present inventions, heat flow from a first deflector layer 22 to a second deflector layer 24 may be viewed as a heating process for the second deflector layer 24 and a cooling process for the first deflector layer 22. Barrier layer 23 may be viewed as establishing a time constant, $\tau_B$, for heat transfer in both heating and cooling processes.

The time constant $\tau_B$ is approximately proportional to the thickness $h_b$ of the barrier layer 23 and inversely proportional to the thermal conductivity of the materials used to construct this layer. As noted previously, the heat pulse input to first deflector layer 22 must be shorter in duration than the heat transfer time constant, otherwise the potential temperature differential and deflection magnitude will be dissipated by excessive heat loss through the barrier layer 23.

A second heat flow ensemble, from the cantilevered element to the surroundings, is indicated by arrows marked $Q_S$. The details of the external heat flows will depend importantly on the application of the thermal actuator. Heat may flow from the actuator to substrate 10, or other adjacent structural elements, by conduction. If the actuator is operating in a liquid or gas, it will lose heat via convection and conduction to these fluids. Heat will also be lost via radiation. For purpose of understanding the present inventions, heat lost to the surrounding may be characterized as a single external cooling time constant $\tau_S$ which integrates the many processes and pathways that are operating.

Another timing parameter of importance is the desired repetition period, $\tau_C$, for operating the thermal actuator. For example, for a liquid drop emitter used in an ink jet printhead, the actuator repetion period establishes the drop firing frequency, which establishes the pixel writing rate that a jet can sustain. Since the heat transfer time constant $\tau_B$ governs the time required for the cantilevered element to restore to a first position, it is preferred that $\tau_B \ll \tau_C$ for energy efficiency and rapid operation. Uniformity in actuation performance from one pulse to the next will improve as the repetition period $\tau_C$ is chosen to be several units of $\tau_B$ or more. That is, $\tau_C>5\tau_B$ then the cantilevered element will have fully equilibrated and returned to the first or nominal position. If, instead $\tau_C<2\tau_B$, then there will be some significant amount of residual deflection remaining when a next deflection is attempted. It is therefore desirable that $\tau_C>2\tau_B$ and more preferably that $\tau_C>4\tau_B$.

The time constant of heat transfer to the surround, $\tau_S$, may influence the actuator repetition period, $\tau_C$, as well. For an efficient design, $\tau_S$ will be significantly longer than $\tau_B$. Therefore, even after the cantilevered element has reached internal thermal equilibrium after a time of 3 to $5\tau_B$, the cantilevered element will be above the ambient temperature or starting temperature, until a time of 3 to $5\tau_S$. A new deflection may be initiated while the actuator is still above ambient temperature. However, to maintain a constant amount of mechanical actuation, higher and higher peak temperatures for the layers of the cantilevered element will be required. Repeated pulsing at periods $\tau_C<3\tau_S$ will cause continuing rise in the maximum temperature of the actuator materials until some failure mode is reached.

A heat sink portion 11 of substrate 10 is illustrated in FIG. 22. When a semiconductor or metallic material such as silicon is used for substrate 10, the indicated heat sink portion 11 may be simply a region of the substrate 10 designated as a heat sinking location. Alternatively, a separate material may be included within substrate 10 to serve as an efficient sink for heat conducted away from the cantilevered element 20 at the anchor portion 34.

The thermal actuators of the present invention allow for active deflection on the cantilevered element 20 in substantially opposing motions and displacements. By applying an electrical pulse to heat the first deflector layer 22, the cantilevered element 20 deflects in a direction away from first deflector layer 22 (see FIGS. 4*b* and 15*b*). By applying an electrical pulse to heat the second deflector layer 24, the cantilevered element 20 deflects in a direction away from the second deflector layer 24 and towards the first deflector layer 22 (see FIGS. 4*c* and 16*b*). The thermo-mechanical forces that cause the cantilevered element 20 to deflect become balanced if internal thermal equilibrium is then allowed to occur via internal heat transfer, for cantilevered elements 20 designed to satisfy above Equation 34, that is, when the thermo-mechanical structure factor c=0.

While much of the foregoing description was directed to the configuration and operation of a single thermal actuator or drop emitter, it should be understood that the present invention is applicable to forming arrays and assemblies of multiple thermal actuators and drop emitter units. Also it should be understood that thermal actuator devices according to the present invention may be fabricated concurrently with other electronic components and circuits, or formed on the same substrate before or after the fabrication of electronic components and circuits.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

PARTS LIST

| | |
|---|---|
| 10 | substrate base element |
| 11 | heat sink portion of substrate 10 |
| 12 | liquid chamber |
| 13 | gap between cantilevered element and chamber wall |
| 14 | cantilevered element anchor location at base element or wall edge |
| 15 | thermal actuator |
| 16 | liquid chamber curved wall portion |
| 18 | location of free end width of the thermo-mechanical bender portion |
| 20 | cantilevered element |
| 21 | passivation layer |
| 22 | first deflector layer |
| 23 | barrier layer |
| 23a | barrier layer sub-layer |

-continued

PARTS LIST

| | |
|---|---|
| 23b | barrier layer sub-layer |
| 24 | second deflector layer |
| 25 | thermo-mechanical bender portion of the cantilevered element |
| 26 | first heater resistor formed in the first deflector layer |
| 27 | second heater resistor formed in the second deflector layer |
| 28 | base end of the thermo-mechanical bender portion |
| 29 | free end of the thermo-mechanical bender portion |
| 30 | nozzle |
| 31 | sacrificial layer |
| 32 | free end tip of cantilevered element |
| 33 | liquid chamber cover |
| 34 | anchored end of cantilevered element |
| 35 | spatial thermal pattern |
| 36 | first spatial thermal pattern |
| 37 | second spatial thermal pattern |
| 38 | passivation overlayer |
| 39 | clearance areas |
| 41 | TAB lead attached to electrode 44 |
| 42 | electrode of first electrode pair |
| 43 | solder bump on electrode 44 |
| 44 | electrode of first electrode pair |
| 45 | TAB lead attached to electrode 46 |
| 46 | electrode of second electrode pair |
| 47 | solder bump on electrode 46 |
| 48 | electrode of second electrode pair |
| 49 | thermal pathway leads |
| 50 | drop |
| 52 | liquid meniscus at nozzle 30 |
| 60 | fluid |
| 61 | thermo-mechanical bender portion with monotonic spatial thermal pattern |
| 62 | thermo-mechanical bender portion with stepped spatial thermal pattern |
| 66 | heater resistor segments |
| 67 | current shunts |
| 68 | current coupling shunt |
| 71 | first patterned current shunt layer |
| 72 | second patterned current shunt layer |
| 75 | current shunt areas formed in first deflector layer 22 |
| 76 | thin film heater resistor layer |
| 77 | current shunt areas formed in thin film heater resistor layer 76 |
| 80 | mounting support structure |
| 100 | ink jet printhead |
| 110 | drop emitter unit |
| 200 | electrical pulse source |
| 300 | controller |
| 400 | image data source |
| 500 | receiver |

What is claimed is:

1. A thermal actuator for a micro-electromechanical device comprising:

(a) a base element;

(b) a cantilevered element including a thermo-mechanical bender portion extending from the base element and a free end tip residing in a first position, the thermo-mechanical bender portion having a base end adjacent the base element and a free end adjacent the free end tip; and (c) apparatus adapted to apply a heat pulse having a spatial thermal pattern directly to the thermo-mechanical bender portion, causing the deflection of the free end tip of the cantilevered element to a second position, and wherein said spatial thermal pattern results in a substantially greater temperature increase of the base end than the free end of the thermo-mechanical bender portion.

2. The thermal actuator of claim 1 wherein the thermo-mechanical bending portion has a normalized free end deflection $\bar{y}(1)>1.0$.

3. The thermal actuator of claim 1 wherein the application of a heat pulse having a spatial thermal pattern results in a base end temperature increase, $\Delta T_b$, of the base end, a free end temperature increase, $\Delta T_f$, of the free end, and the temperature increase of the thermo-mechanical bender portion reduces monotonically from $\Delta T_b$ to $\Delta T_f$ as a function of the distance from the base element.

4. The thermal actuator of claim 3 wherein the temperature increase of the thermo-mechanical bender portion reduces monotonically from $\Delta T_b$ to $\Delta T_f$ as a substantially linear function of the distance from the base element.

5. The thermal actuator of claim 3 wherein the temperature increase of the thermno-mechanical bender portion reduces monotonically from $\Delta T_b$ to $\Delta T_f$ as a substantially quadratic function of the distance from the base element.

6. The thermal actuator of claim 3 wherein the temperature increase of the thermo-mechanical bender portion reduces monotonically from $\Delta T_b$ to $\Delta T_f$ as a substantially inverse-power function of the distance from the base element.

7. The thermal actuator of claim 1 wherein the application of a heat pulse having a spatial thermal pattern results in a base end temperature increase, $\Delta T_b$, of the base end, a free end temperature increase, $\Delta T_f$, of the free end, and the temperature increase of the thermo-mechanical bending portion reduces from $\Delta T_b$ to $\Delta T_f$ in at least one temperature reduction step.

8. The thermal actuator of claim 7 wherein the thermo-mechanical bender portion has a length L and the at least one temperature reduction step occurs at a distance $L_s$ from the base element, wherein $0.3\ L \leqq L_s \leqq 0.7\ L$.

9. The thermal actuator of claim 1 wherein the apparatus adapted to apply a heat pulse comprises a patterned thin film resistor layer.

10. The thermal actuator of claim 9 wherein the spatial thermal pattern results in part from spatially modifying the conductivity of the thin film resistor layer.

11. The thermal actuator of claim 1 wherein the thermo-mechanical bender portion includes a first deflector layer constructed of a first material having a high coefficient of thermal expansion and a second layer, attached to the first deflector layer, constructed of a second material having a low coefficient of thermal expansion.

12. The thermal actuator of claim 11 wherein the first material is electrically resistive having a first sheet resistance and the apparatus adapted to apply a heat pulse comprises a resistor pattern formed in the first deflector layer.

13. The thermal actuator of claim 12 wherein the spatial thermal pattern results in part from spatially modifying the first sheet resistance in a current shunt pattern.

14. The thermal actuator of claim 12 further comprising a conductor layer constructed of an electrically conductive material adjacent the first deflector layer wherein the spatial thermal pattern results in part from patterning the conductor layer in a current shunt pattern.

15. The thermal actuator of claim 11 wherein the first material is titanium aluminide.

16. A liquid drop emitter comprising:

(a) a chamber, formed in a substrate, filled with a liquid and having a nozzle for emitting drops of the liquid;

(b) a thermal actuator having a cantilevered element including a thermo-mechanical bender portion extending from a wall of the chamber and a free end tip residing in a first position proximate to the nozzle, the thermo-mechanical bender portion having a base end adjacent the base element and a free end adjacent the free end tip; and (c) apparatus adapted to apply a heat pulse having a spatial thermal pattern directly to the thermo-mechanical bender portion causing a rapid deflection of the free end tip and ejection of a liquid drop, and wherein said spatial thermal pattern results in a substantially greater temperature increase of the base end than the free end of the thermo-mechanical bending portion.

17. The liquid drop emitter of claim 16 wherein the thermo-mechanical bending portion has a normalized free end deflection $\bar{y}(1)>1.0$.

18. The liquid drop emitter of claim 16 wherein the liquid drop emitter is a drop-on-demand ink jet printhead and the liquid is an ink for printing image data.

19. The liquid drop emitter of claim 16 wherein the application of a heat pulse having a spatial thermal pattern results in a base end temperature increase, $\Delta T_b$, of the base end, a free end temperature increase, $\Delta T_f$, of the free end, and the temperature increase of the thermo-mechanical bender portion reduces monotonically from $\Delta T_b$ to $\Delta T_f$ as a function of the distance from the base element.

20. The liquid drop emitter of claim 19 wherein the temperature increase of the thermo-mechanical bender portion reduces monotonically from $\Delta T_b$ to $\Delta T_f$ as a substantially linear function of the distance from the base element.

21. The liquid drop emitter of claim 19 wherein the temperature increase of the thermo-mechanical bender portion reduces monotonically from $\Delta T_b$ to $\Delta T_f$ as a substantially quadratic function of the distance from the base element.

22. The liquid drop emitter of claim 19 wherein the temperature increase of the thermo-mechanical bender portion reduces monotonically from $\Delta T_b$ to $\Delta T_f$ as a substantially inverse-power function of the distance from the base element.

23. The liquid drop emitter of claim 16 wherein the application of a heat pulse having a spatial thermal pattern results in a base end temperature increase, $\Delta T_b$, of the base end, a free end temperature increase, $\Delta T_f$, of the free end, and the temperature increase of the thermo-mechanical bending portion reduces from $\Delta T_b$ to $\Delta T_f$ in at least one temperature reduction step.

24. The liquid drop emitter of claim 23 wherein the thermo-mechanical bender portion has a length L and the at least one temperature reduction step occurs at a distance $L_s$ from the base element, wherein $0.3\ L \leqq L_s \leqq 0.7\ L$.

25. The liquid drop emitter of claim 16 wherein the apparatus adapted to apply a heat pulse comprises a patterned thin film resistor layer.

26. The liquid drop emitter of claim 25 wherein the spatial thermal pattern results in part from spatially modifying the conductivity of the thin film resistor layer.

27. The liquid drop emitter of claim 16 wherein the thermo-mechanical bender portion includes a first deflector layer constructed of a first material having a high coefficient of thermal expansion and a second layer, attached to the first deflector layer, constructed of a second material having a low coefficient of thermal expansion.

28. The liquid drop emitter of claim 27 wherein the first material is electrically resistive having a first sheet resistance and the apparatus adapted to apply a heat pulse comprises a resistor pattern formed in the first deflector layer.

29. The liquid drop emitter of claim 28 wherein the spatial thermal pattern results in part from spatially modifying the first sheet resistance in a current shunt pattern.

30. The liquid drop emitter of claim 27 wherein the first material is titanium aluminide.

31. The liquid drop emitter of claim 28 further comprising a conductor layer constructed of an electrically conductive material adjacent the first deflector layer wherein the spatial thermal pattern results in part from patterning the conductor layer in a current shunt pattern.

32. A thermal actuator for a micro-electromechanical device comprising:

(a) a base element;

(b) a cantilevered element including a thermo-mechanical bender portion extending from the base element to a free end tip residing at a first position, the thermo-mechanical bender portion having a base end adjacent the base element and a free end adjacent the free end tip, the thermo-mechanical bender portion further including a first deflector layer constructed of a first material having a large coefficient of thermal expansion, a second deflector layer, and a barrier layer constructed of a dielectric material having low thermal conductivity wherein the barrier layer is bonded between the first deflector layer and the second deflector layer; and (c) apparatus adapted to apply a heat pulse having a spatial thermal pattern directly to the first deflector layer, causing the deflection of the free end tip of the cantilevered element to a second position, followed by restoration of the cantilevered element to the first position as heat diffuses through the barrier layer to the second deflector layer and the cantilevered element reaches a uniform temperature, and wherein said spatial thermal pattern results in a substantially greater temperature increase of the base end than the free end of the first deflector layer.

33. The thermal actuator of claim 32 wherein the thermo-mechanical bending portion has a normalized free end deflection $\bar{y}(1)>1.0$.

34. The thermal actuator of claim 32 wherein the application of a heat pulse having a spatial thermal pattern results in a base end temperature increase, $\Delta T_b$, of the base end, a free end temperature increase, $\Delta T_f$, of the free end, and the temperature increase of the thermo-mechanical bender portion reduces monotonically from $\Delta T_b$ to $\Delta T_f$ as a function of the distance from the base element.

35. The thermal actuator of claim 34 wherein the temperature increase of the thermo-mechanical bender portion reduces monotonically from $\Delta T_b$ to $\Delta T_f$ as a substantially linear function of the distance from the base element.

36. The thermal actuator of claim 34 wherein the temperature increase of the thermo-mechanical bender portion reduces monotonically from $\Delta T_b$ to $\Delta T_f$ as a substantially quadratic function of the distance from the base element.

37. The thermal actuator of claim 34 wherein the temperature increase of the thermo-mechanical bender portion reduces monotonically from $\Delta T_b$ to $\Delta T_f$ as a substantially inverse-power function of the distance from the base element.

38. The thermal actuator of claim 32 wherein the application of a heat pulse having a spatial thermal pattern results in a base end temperature increase, $\Delta T_b$, of the base end, a free end temperature increase, $\Delta T_f$, of the free end, and the temperature increase of the thermo-mechanical bending portion reduces from $\Delta T_b$ to $\Delta T_f$ in at least one temperature reduction step.

39. The thermal actuator of claim 38 wherein the thermo-mechanical bender portion has a length L and the at least one temperature reduction step occurs at a distance $L_s$ from the base element, wherein $0.3\ L \leqq L_s \leqq 0.7\ L$.

40. The thermal actuator of claim 32 wherein the apparatus adapted to apply a heat pulse comprises a patterned thin film resistor layer.

41. The thermal actuator of claim 40 wherein the spatial thermal pattern results in part from spatially modifying the conductivity of the thin film resistor layer.

42. The thermal actuator of claim 32 wherein the first material is electrically resistive having a first sheet resistance and the apparatus adapted to apply a heat pulse comprises a resistor pattern formed in the first deflector layer.

43. The thermal actuator of claim 42 wherein the spatial thermal pattern results in part from spatially modifying the first sheet resistance in a current shunt pattern.

44. The thermal actuator of claim 32 wherein the first material is titanium aluminide.

45. The thermal actuator of claim 42 further comprising a conductor layer constructed of an electrically conductive material adjacent the first deflector layer wherein the spatial thermal pattern results in part from patterning the conductor layer in a current shunt pattern.

46. The thermal actuator of claim 32 wherein the second deflector layer is constructed of the first material and the first deflector layer and the second deflector layer are substantially equal in thickness.

47. The thermal actuator of claim 32 wherein the heat pulse has a time duration of $\tau_p$, the barrier layer has a heat transfer time constant of $\tau_B$, and $\tau_B>2\ \tau_p$.

48. A liquid drop emitter comprising:

(a) a chamber, formed in a substrate, filled with a liquid and having a nozzle for emitting drops of the liquid;

(b) a cantilevered element including a thermo-mechanical bender portion extending from a wall of the chamber to a free end tip residing at a first position proximate to the nozzle, the thermo-mechanical bender portion having a base end adjacent the base element and a free end adjacent the free end tip, the thermo-mechanical bender portion further including a first deflector layer constructed of a first material having a large coefficient of thermal expansion, a second deflector layer, and a barrier layer constructed of a dielectric material having low thermal conductivity wherein the barrier layer is bonded between the first deflector layer and the second deflector layer; and (c) apparatus adapted to apply a heat pulse having a spatial thermal pattern directly to the first deflector layer, causing a rapid deflection of the free end tip and ejection of a liquid drop, followed by restoration of the cantilevered element to the first position as heat diffuses through the barrier layer to the second deflector layer and the cantilevered element reaches a uniform temperature, and wherein said spatial thermal pattern results in a substantially greater temperature increase of the base end than the free end of the first deflector layer.

49. The liquid drop emitter of claim 48 wherein the thermo-mechanical bending portion has a normalized free end deflection $\bar{y}(1)>1.0$.

50. The liquid drop emitter of claim 48 wherein the application of a heat pulse having a spatial thermal pattern results in a base end temperature increase, $\Delta T_b$, of the base end, a free end temperature increase, $\Delta T_f$, of the free end, and the temperature increase of the thermo-mechanical bender portion reduces monotonically from $\Delta T_b$ to $\Delta T_f$ as a function of the distance from the base element.

51. The liquid drop emitter of claim 50 wherein the temperature increase of the thermo-mechanical bender portion reduces monotonically from $\Delta T_b$ to $\Delta T_f$ as a substantially linear function of the distance from the base element.

52. The liquid drop emitter of claim 50 wherein the temperature increase of the thermo-mechanical bender portion reduces monotonically from $\Delta T_b$ to $\Delta T_f$ as a substantially quadratic function of the distance from the base element.

53. The liquid drop emitter of claim 50 wherein the temperature increase of the thermo-mechanical bender portion reduces monotonically from $\Delta T_b$ to $\Delta T_f$ as a substantially inverse-power function of the distance from the base element.

54. The liquid drop emitter of claim 48 wherein the application of a heat pulse having a spatial thermal pattern results in a base end temperature increase, $\Delta T_b$, of the base end, a free end temperature increase, $\Delta T_f$, of the free end, and the temperature increase of the thermo-mechanical bending portion reduces from $\Delta T_b$ to $\Delta T_f$ in at least one temperature reduction step.

55. The liquid drop emitter of claim 54 wherein the thermo-mechanical bender portion has a length L and the at least one temperature reduction step occurs at a distance $L_s$ from the base element, wherein $0.3\ L \leqq L_s \leqq 0.7\ L$.

56. The liquid drop emitter of claim 48 wherein the apparatus adapted to apply a heat pulse comprises a patterned thin film resistor layer.

57. The liquid drop emitter of claim 56 wherein the spatial thermal pattern results in part from spatially modifying the conductivity of the thin film resistor layer.

58. The liquid drop emitter of claim 48 wherein the first material is electrically resistive having a first sheet resistance and the apparatus adapted to apply a heat pulse comprises a resistor pattern formed in the first deflector layer.

59. The liquid drop emitter of claim 58 wherein the spatial thermal pattern results in part from spatially modifying the first sheet resistance in a current shunt pattern.

60. The liquid drop emitter of claim 58 further comprising a conductor layer constructed of an electrically conductive material adjacent the first deflector layer wherein the spatial thermal pattern results in part from patterning the conductor layer in a current shunt pattern.

61. The liquid drop emitter of claim 48 wherein the first material is titanium aluminide.

62. The liquid drop emitter of claim 48 wherein the second deflector layer is constructed of the first material and the first deflector layer and the second deflector layer are substantially equal in thickness.

63. The liquid drop emitter of claim 48 wherein the heat pulse has a time duration of $\tau_p$, the barrier layer has a heat transfer time constant of $\tau_B$, and $\tau_B > 2\ \tau_p$.

64. The liquid drop emitter of claim 48 wherein the liquid drop emitter is a drop-on-demand ink jet printhead and the liquid is an ink for printing image data.

65. A thermal actuator for a micro-electromechanical device comprising:

(a) a base element;

(b) a cantilevered element including a thermo-mechanical bender portion extending from the base element to a free end tip residing at a first position, the thermo-mechanical bender portion having a base end adjacent the base element and a free end adjacent the free end tip, the thermo-mechanical bender portion further including the cantilevered element including a barrier layer constructed of a dielectric material having low thermal conductivity, a first deflector layer constructed of a first electrically resistive material having a large coefficient of thermal expansion, and a second deflector layer constructed of a second electrically resistive material having a large coefficient of thermal expansion wherein the barrier layer is bonded between the first and second deflector layers;

(c) a first heater resistor formed in the first deflector layer and adapted to apply heat energy having a first spatial thermal pattern which results in a first deflector layer base end temperature increase, $\Delta T_{1b}$, in the first deflector layer at the base end that is greater than a first deflector layer free end temperature increase, $\Delta T_{1f}$, in the first deflector layer at the free end;

(d) a second heater resistor formed in the second deflector layer and adapted to apply heat energy having a second spatial thermal pattern which results in a second deflector layer base end temperature increase, $\Delta T_{2b}$, in the second deflector layer at the base end that is greater than a second deflector layer free end temperature increase, $\Delta T_{2f}$, in the second deflector layer at the free end;

(e) a first pair of electrodes connected to the first heater resistor to apply an electrical pulse to cause resistive heating of the first deflector layer, resulting in a thermal expansion of the first deflector layer relative to the second deflector layer;

(f) a second pair of electrodes connected to the second heater resistor portion to apply an electrical pulse to cause resistive heating of the second deflector layer, resulting in a thermal expansion of the second deflector layer relative to the first deflector layer, wherein application of an electrical pulse to either the first pair or the second pair of electrodes causes deflection of the cantilevered element away from the first position to a second position, followed by restoration of the cantilevered element to the first position as beat diffuses through the barrier layer and the cantilevered element reaches a uniform temperature.

66. The thermal actuator of claim 65 wherein the first spatial thermal pattern results in the temperature increase of the first deflector layer of the thermo-mechanical bender portion reducing monotonically from $\Delta T_{1b}$ to $\Delta T_{1f}$ as a function of the distance from the base element.

67. The thermal actuator of claim 66 wherein the thermo-mechanical bending portion has a normalized free end deflection $\bar{y}(1) > 1.0$.

68. The thermal actuator of claim 65 wherein the second spatial thermal pattern results in the temperature increase of the second layer of the thermo-mechanical bender portion reducing monotonically from $\Delta T_{2b}$ to $\Delta T_{2f}$ as a function of the distance from the base element.

69. The thermal actuator of claim 68 wherein the thermo-mechanical bending portion has a normalized free end deflection $\bar{y}(1) > 1.0$.

70. The thermal actuator of claim 65 wherein the first spatial thermal pattern results in the temperature increase of the first deflector layer of the thermo-mechanical bender portion reducing from $\Delta T_{1b}$ to $\Delta T_{1f}$ in at least one temperature reduction step.

71. The thermal actuator of claim 65 wherein the second spatial thermal pattern results in the temperature increase of the second layer of the thermo-mechanical bender portion reducing from $\Delta T_{2b}$ to $\Delta T_{2f}$ in at least one temperature reduction step.

72. The thermal actuator of claim 65 wherein the first and second electrically resistive materials are the same material and the first and second deflector layers are substantially equal in thickness.

73. The thermal actuator of claim 65 wherein the first and second electrically resistive materials are titanium aluminide.

74. The thermal actuator of claim 65 wherein the first electrically resistive material has a first sheet resistance and the spatial thermal pattern results in part from spatially modifying the first sheet resistance in a current shunt pattern.

75. The thermal actuator of claim 65 wherein the second electrically resistive material has a second sheet resistance and the spatial thermal pattern results in part from spatially modifying the second sheet resistance in a current shunt pattern.

76. The thermal actuator of claim 65 further comprising a first conductor layer constructed of an electrically conductive material adjacent the first deflector layer wherein the spatial thermal pattern results in part from patterning the first conductor layer in a current shunt pattern.

77. The thermal actuator of claim 65 further comprising a second conductor layer constructed of an electrically conductive material adjacent the second deflector layer wherein the spatial thermal pattern results in part from patterning the second conductor layer in a current shunt pattern.

78. A liquid drop emitter comprising:

(a) a chamber, formed in a substrate, filled with a liquid and having a nozzle for emitting drops of the liquid;

(b) a thermal actuator having a cantilevered element including a thermo-mechanical bender portion extending from a wall of the chamber and a free end tip residing in a first position proximate to the nozzle, the thermo-mechanical bender portion having a base end adjacent the base element and a free end adjacent the free end tip, the thermo-mechanical bender portion further including a barrier layer constructed of a dielectric material having low thermal conductivity, a first deflector layer constructed of a first electrically resistive material having a large coefficient of thermal expansion, and a second deflector layer constructed of a second electrically resistive material having a large coefficient of thermal expansion wherein the barrier layer is bonded between the first and second deflector layers;

(c) a first heater resistor formed in the first deflector layer and adapted to apply heat energy having a first spatial thermal pattern which results in a first deflector layer base end temperature increase, $\Delta T_{1b}$, in the first deflector layer at the base end that is greater than a first deflector layer free end temperature increase, $\Delta T_{1f}$, in the first deflector layer at the free end;

(d) a second heater resistor formed in the second deflector layer and adapted to apply heat energy having a second spatial thermal pattern which results in a second deflector layer base end temperature increase, $\Delta T_{2b}$, in the second deflector layer at the base end that is greater than a second deflector layer free end temperature increase, $\Delta T_{2f}$, in the second deflector layer at the free end;

(e) a first pair of electrodes connected to the first heater resistor to apply an electrical pulse to cause resistive heating of the first deflector layer, resulting in a thermal expansion of the first deflector layer relative to the second deflector layer;

(f) a second pair of electrodes connected to the second heater resistor portion to apply an electrical pulse to cause resistive heating of the second deflector layer, resulting in a thermal expansion of the second deflector layer relative to the first deflector layer, wherein application of electrical pulses to the first and second pairs of electrodes causes rapid deflection of the cantilevered element, ejecting liquid at the nozzle, followed by restoration of the cantilevered element to the first position as heat diffuses through the barrier layer and the cantilevered element reaches a uniform temperature.

79. The liquid drop emitter of claim 78 wherein the liquid drop emitter is a drop-on-demand ink jet printhead and the liquid is an ink for printing image data.

80. The liquid drop emitter of claim 78 wherein the first spatial thermal pattern results in the temperature increase of the first deflector layer of the thermo-mechanical bender portion reducing monotonically from $\Delta T_{1b}$ to $\Delta T_{1f}$ as a function of the distance from the base element.

81. The thermal actuator of claim 80 wherein the thermo-mechanical bending portion has a normalized free end deflection $\bar{y}(1)>1.0$.

82. The liquid drop emitter of claim 78 wherein the second spatial thermal pattern results in the temperature increase of the second layer of the thermo-mechanical bender portion reducing monotonically from $\Delta T_{2b}$ to $\Delta T_{2f}$ as a function of the distance from the base element.

83. The thermal actuator of claim 82 wherein the thermo-mechanical bending portion has a normalized free end deflection $\bar{y}(1)>1.0$.

84. The liquid drop emitter of claim 78 wherein the first spatial thermal pattern results in the temperature increase of the first deflector layer of the thermo-mechanical bender portion reducing from $\Delta T_{1b}$ to $\Delta T_{1f}$ in at least one temperature reduction step.

85. The liquid drop emitter of claim 78 wherein the second spatial thermal pattern results in the temperature increase of the second layer of the thermo-mechanical bender portion reducing from $\Delta T_{2b}$ to $\Delta T_{2f}$ in at least one temperature reduction step.

86. The liquid drop emitter of claim 78 wherein the first and second electrically resistive materials are the same material and the first and second deflector layers are substantially equal in thickness.

87. The liquid drop emitter of claim 78 wherein the first and second electrically resistive materials are titanium aluminide.

88. The liquid drop emitter of claim 78 wherein the first electrically resistive material has a first sheet resistance and the spatial thermal pattern results in part from spatially modifying the first sheet resistance in a current shunt pattern.

89. The liquid drop emitter of claim 78 wherein the second electrically resistive material has a second sheet resistance and the spatial thermal pattern results in part from spatially modifying the second sheet resistance in a current shunt pattern.

90. The liquid drop emitter of claim 78 further comprising a first conductor layer constructed of an electrically conductive material adjacent the first deflector layer wherein the spatial thermal pattern results in part from patterning the first conductor layer in a current shunt pattern.

91. The liquid drop emitter of claim 78 further comprising a second conductor layer constructed of an electrically conductive material adjacent the second deflector layer wherein the spatial thermal pattern results in part from patterning the second conductor layer in a current shunt pattern.

* * * * *